US008295752B2

(12) United States Patent
Tomita et al.

(10) Patent No.: US 8,295,752 B2
(45) Date of Patent: Oct. 23, 2012

(54) FIXING DEVICE AND IMAGE FORMING APPARATUS

(75) Inventors: Yuhei Tomita, Ebina (JP); Eiichiro Tokuhiro, Ebina (JP); Shigehiko Haseba, Ebina (JP); Takayuki Uchiyama, Ebina (JP); Motofumi Baba, Ebina (JP); Nobuyoshi Komatsu, Ebina (JP); Yasutaka Naito, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 491 days.

(21) Appl. No.: 12/561,819

(22) Filed: Sep. 17, 2009

(65) Prior Publication Data

US 2010/0215390 A1 Aug. 26, 2010

(30) Foreign Application Priority Data

Feb. 25, 2009 (JP) ..... 2009-042065
Mar. 27, 2009 (JP) ..... 2009-080574

(51) Int. Cl.
*G03G 15/20* (2006.01)

(52) U.S. Cl. ..... 399/329; 399/33; 399/69

(58) Field of Classification Search ..... 399/33, 399/69, 328, 329; 347/156
See application file for complete search history.

(56) References Cited

U.S. PATENT DOCUMENTS

| | | | | |
|---|---|---|---|---|
| 7,382,995 | B2 | 6/2008 | Itoh et al. | 399/67 |
| 2007/0047991 | A1* | 3/2007 | Itoh et al. | 399/69 |
| 2007/0231026 | A1* | 10/2007 | Hayashi et al. | 399/329 |
| 2008/0124111 | A1* | 5/2008 | Baba et al. | 399/69 |

FOREIGN PATENT DOCUMENTS

| | | |
|---|---|---|
| JP | 62-208080 | 9/1987 |
| JP | 2002-221872 | 8/2002 |
| JP | 2003-091187 | 3/2003 |
| JP | 2003-186322 | 7/2003 |
| JP | 2004-037412 | 2/2004 |
| JP | 2006-267332 | 10/2006 |
| JP | 2006-267742 | 10/2006 |
| JP | 2007-057827 | 3/2007 |
| JP | 2007-114524 A | 5/2007 |
| JP | 2006-047769 | 2/2008 |
| JP | 2008-129517 | 6/2008 |
| JP | 2008-152247 | 7/2008 |

OTHER PUBLICATIONS

English translation of Japanese Office Action for JP2009-080574 dated Nov. 1, 2011.

* cited by examiner

*Primary Examiner* — Sandra Brase
(74) *Attorney, Agent, or Firm* — Sughrue Mion, PLLC

(57) ABSTRACT

The fixing device includes: a fixing member including a conductive layer capable of self-heating by electromagnetic induction; a drive unit rotationally driving the fixing member; a magnetic field generating member generating an alternate-current magnetic field intersecting with the conductive layer; a fixation pressing member movable so as to come into pressure contact with an outer circumferential surface of the fixing member and to separate from the outer circumferential surface; and a temperature measurement unit that includes a temperature detector and a support portion, that measures temperature of the fixing member with the temperature detector which is pressed by the support portion to be brought into contact with an inner circumferential surface of the fixing member, and that holds a contact state between the temperature detector and the inner circumferential surface in every state where the fixing member is displaced in accordance with movement of the fixation pressing member.

18 Claims, 19 Drawing Sheets

FIXING DEVICE AND IMAGE FORMING APPARATUS

CROSS REFERENCE TO RELATED APPLICATIONS

This application is based on and claims priority under 35 USC §119 from Japanese Patent Applications No. 2009-42065 filed Feb. 25, 2009, and No. 2009-80574 filed Mar. 27, 2009.

BACKGROUND

1. Technical Field

The present invention relates to a fixing device and an image forming apparatus.

2. Related Art

Fixing devices using an electromagnetic induction heating system are known as the fixing devices each installed in an image forming apparatus, such as a copy machine and a printer, using an electrophotographic system.

SUMMARY

According to an aspect of the present invention, there is provided a fixing device including: a fixing member that includes a conductive layer capable of self-heating by electromagnetic induction; a drive unit that rotationally drives the fixing member; a magnetic field generating member that generates an alternate-current magnetic field intersecting with the conductive layer of the fixing member; a fixation pressing member that is movable so as to come into pressure contact with an outer circumferential surface of the fixing member and to separate from the outer circumferential surface; and a temperature measurement unit that includes a temperature detector and a support portion, that measures temperature of the fixing member with the temperature detector which is pressed by the support portion to be brought into contact with an inner circumferential surface of the fixing member, and that holds a contact state between the temperature detector and the inner circumferential surface of the fixing member in every state where the fixing member is displaced in accordance with movement of the fixation pressing member.

BRIEF DESCRIPTION OF THE DRAWINGS

Exemplary embodiments of the present invention will be described in detail based on the following figures, wherein.

DETAILED DESCRIPTION

An exemplary embodiment of the present invention will be described below in detail with reference to the accompanying drawings.

<Description of Image Forming Apparatus>

Figure 1:
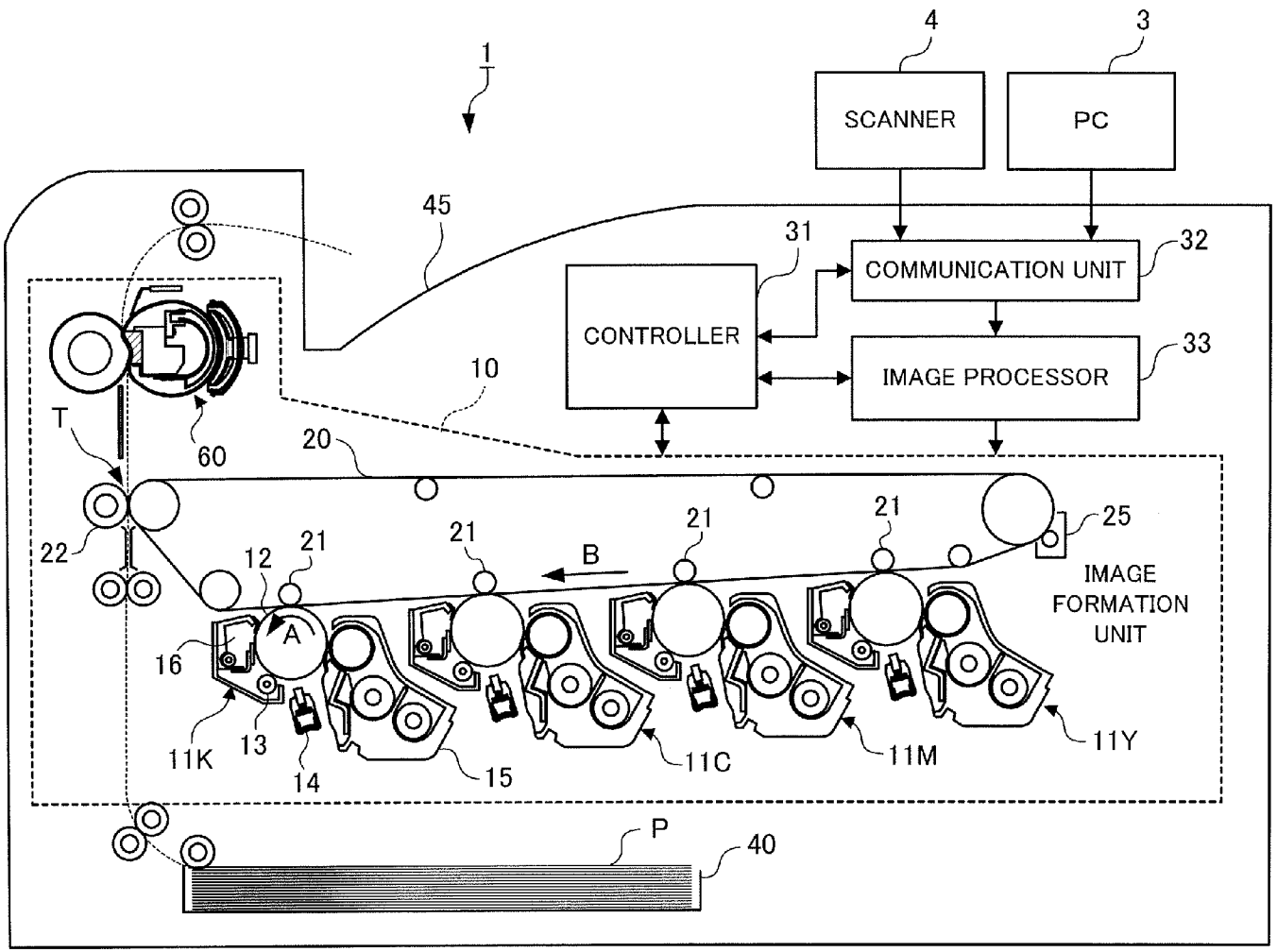
FIG. 1 is a diagram showing a configuration example of an image forming apparatus to which a fixing device of the exemplary embodiment is applied.

FIG. 1 is a diagram showing a configuration example of an image forming apparatus to which a fixing device of the exemplary embodiment is applied. An image forming apparatus 1 shown in FIG. 1 is a so-called tandem-type color printer, and includes: an image formation unit 10 that performs image formation on the basis of image data; and a controller 31 that controls operations of the entire image forming apparatus 1. The image forming apparatus 1 further includes: a communication unit 32 that communicates with, for example, a personal computer (PC) 3, an image reading apparatus (scanner) 4 or the like to receive image data; and an image processor 33 that performs image processing set in advance on image data received by the communication unit 32.

The image formation unit 10 includes four image forming units 11Y, 11M, 11C and 11K (also collectively referred to as an "image forming unit 11") as examples of a toner image forming unit, which are arranged side by side at certain intervals. Each of the image forming units 11 includes: a photoconductive drum 12 as an example of an image carrier that forms an electrostatic latent image and holds a toner image; a charging device 13 that uniformly charges the surface of the photoconductive drum 12 at a predetermined potential; a light emitting diode (LED) print head 14 that exposes, on the basis of color image data, the photoconductive drum 12 charged by the charging device 13; a developing device 15 that develops the electrostatic latent image formed on the photoconductive drum 12; and a drum cleaner 16 that cleans the surface of the photoconductive drum 12 after the transfer.

The image forming units 11 have almost the same configuration except toner contained in the developing device 15, and form yellow (Y), magenta (M), cyan (C) and black (K) color toner images, respectively.

Further, the image formation unit 10 includes: an intermediate transfer belt 20 onto which multiple layers of color toner images formed on the photoconductive drums 12 of the image forming units 11 are transferred; and primary transfer rolls 21 that sequentially transfer (primarily transfer) color toner images formed in respective image forming units 11 onto the intermediate transfer belt 20. Furthermore, the image formation unit 10 includes: a secondary transfer roll 22 that collectively transfers (secondarily transfers) the color toner images superimposingly transferred onto the intermediate transfer belt 20 onto a sheet P which is a recording medium (recording sheet); and a fixing unit 60 as an example of a fixing unit (a fixing device) that fixes the color toner images having been secondarily transferred, onto the sheet P. Note that, in the image forming apparatus 1 according to the present exemplary embodiment, the intermediate transfer belt 20, the primary transfer rolls 21 and the secondary transfer roll 22 configure a transfer unit.

In the image forming apparatus 1 of the present exemplary embodiment, image formation processing using the following processes is performed under operations controlled by the controller 31. Specifically, image data from the PC 3 or the scanner 4 is received by the communication unit 32, and after the image data is subjected to certain image processing performed by the image processor 33, the image data of each color is generated and sent to a corresponding one of the image forming units 11. Then, in the image forming unit 11K that forms a black-color (K) toner image, for example, the photoconductive drum 12 is uniformly charged by the charging device 13 at the potential set in advance while rotating in a direction of an arrow A, and then is exposed by the LED print head 14 on the basis of the black-color image data transmitted from the image processor 33. Thereby, an electrostatic latent image for the black-color image is formed on the photoconductive drum 12. The black-color electrostatic latent image formed on the photoconductive drum 12 is then developed by the developing device 15. Then, the black-color toner image is formed on the photoconductive drum 12. In the same manner, yellow (Y), magenta (M) and cyan (C) color toner images are formed in the image forming units 11Y, 11M and 11C, respectively.

The color toner images formed on the respective photoconductive drums 12 in the image forming units 11 are electrostatically transferred (primarily transferred), in sequence, onto the intermediate transfer belt 20 that moves in a direction of an arrow B, by the primary transfer rolls 21. Then, superimposed toner images on which the color toner images are superimposed on one another are formed. Then, the superimposed toner images on the intermediate transfer belt 20 are transported to a region (secondary transfer portion T) at which the secondary transfer roll 22 is arranged, along with the movement of the intermediate transfer belt 20. The sheet P is supplied from a sheet holding unit 40 to the secondary transfer portion T at a timing when the superimposed toner images being transported arrive at the secondary transfer portion T. Then, the superimposed toner images are collectively and electrostatically transferred (secondarily transferred) onto the transported sheet P by action of a transfer electric field formed at the secondary transfer portion T by the secondary transfer roll 22.

Thereafter, the sheet P onto which the superimposed toner images are electrostatically transferred is transported toward the fixing unit 60. The toner images on the sheet P transported to the fixing unit 60 are heated and pressurized by the fixing unit 60 and thereby are fixed onto the sheet P. Then, the sheet P including the fixed images formed thereon is transported to a sheet output unit 45 provided at an output portion of the image forming apparatus 1.

Meanwhile, the toner (primary-transfer residual toner) attached to the photoconductive drums 12 after the primary transfer and the toner (secondary-transfer residual toner) attached to the intermediate transfer belt 20 after the secondary transfer are removed by the drum cleaners 16 and a belt cleaner 25, respectively.

In this way, the image formation processing in the image forming apparatus 1 is repeatedly performed for a designated number of print sheets.

<Description of Configuration of Fixing Unit>

Next, a description will be given of the fixing unit 60 in the present exemplary embodiment.

Figure 2:
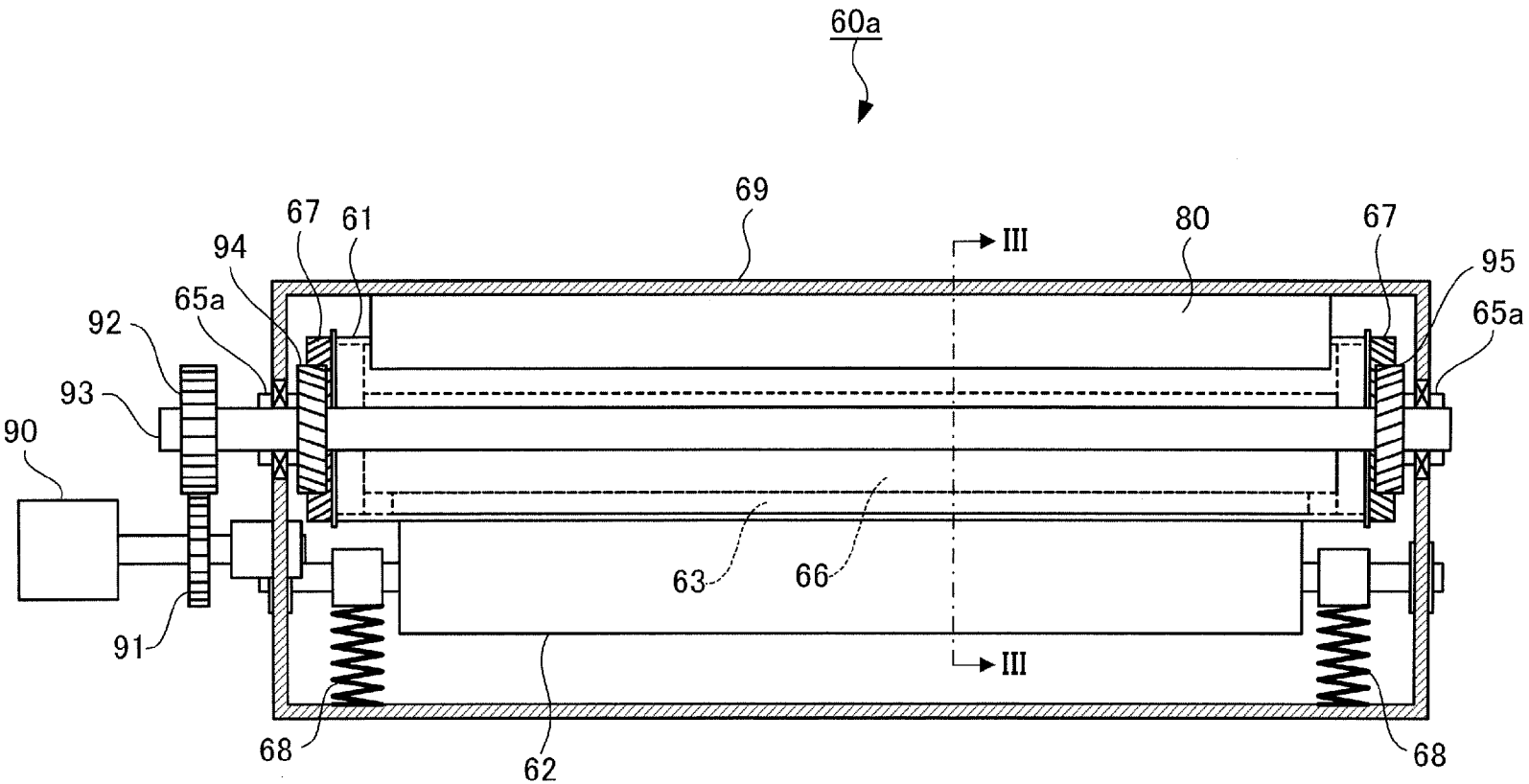
FIG. 2 is a front view of a first configuration of the fixing unit of the exemplary embodiment.
Figure 3:
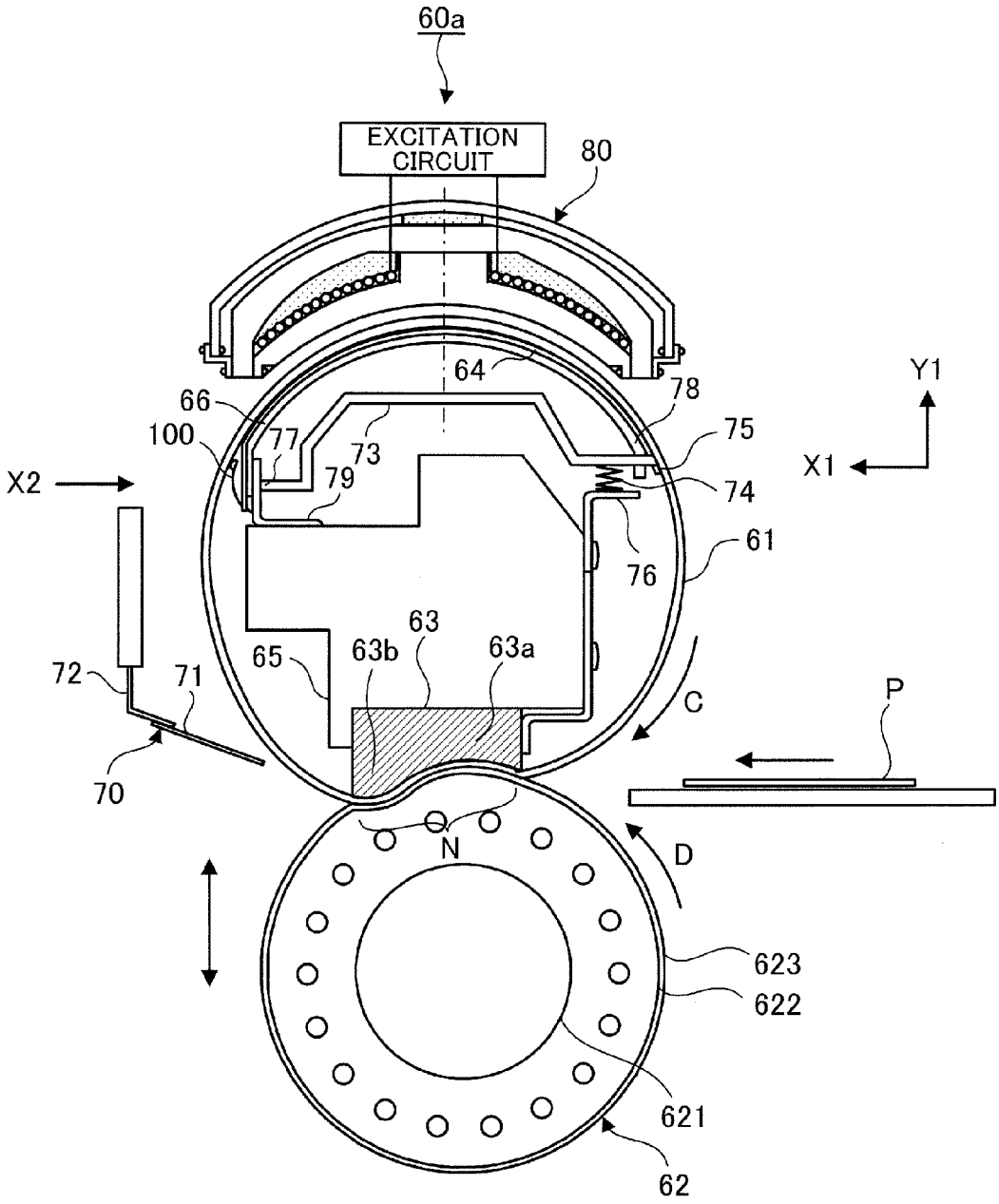
FIG. 3 is a cross sectional view of the fixing unit, taken along the line III-III in FIG. 2.

FIGS. 2 and 3 are diagrams showing a first configuration of the fixing unit of the exemplary embodiment. FIG. 2 is a front view of the fixing unit, and FIG. 3 is a cross sectional view of the fixing unit, taken along the line III-III in FIG. 2.

Firstly, as shown in FIG. 3, which is a cross sectional view, the fixing unit 60*a* includes: an induction heating (IH) heater 80 as an example of a magnetic field generating member that generates an AC (alternate-current) magnetic field; a fixing belt 61 as an example of a fixing member that is subjected to electromagnetic induction heating by the IH heater 80, and thereby fixes a toner image; a pressure roll 62 as an example of a fixation pressing member (roll member) that is arranged in a manner to face the fixing belt 61; and a pressing pad 63 that is pressed by the pressure roll 62 with the fixing belt 61 therebetween.

The fixing unit 60*a* further includes: a frame (holder) 65 that supports a constituent member such as the pressing pad 63; a temperature-sensitive magnetic member 64 that forms a magnetic path by inducing the AC magnetic field generated at the IH heater 80; an induction member 66 that induces magnetic field lines passing through the temperature-sensitive magnetic member 64; a magnetic path shielding member 73 that prevents the magnetic path from leaking toward the frame 65; a temperature sensor 100 as an example of a temperature measurement unit that is arranged so as to be in contact with the surface of the fixing belt 61 and that measures the temperature of the fixing belt 61; and a peeling assisting member 70 that assists peeling of the sheet P from the fixing belt 61.

<Description of Fixing Belt>

Figure 4:
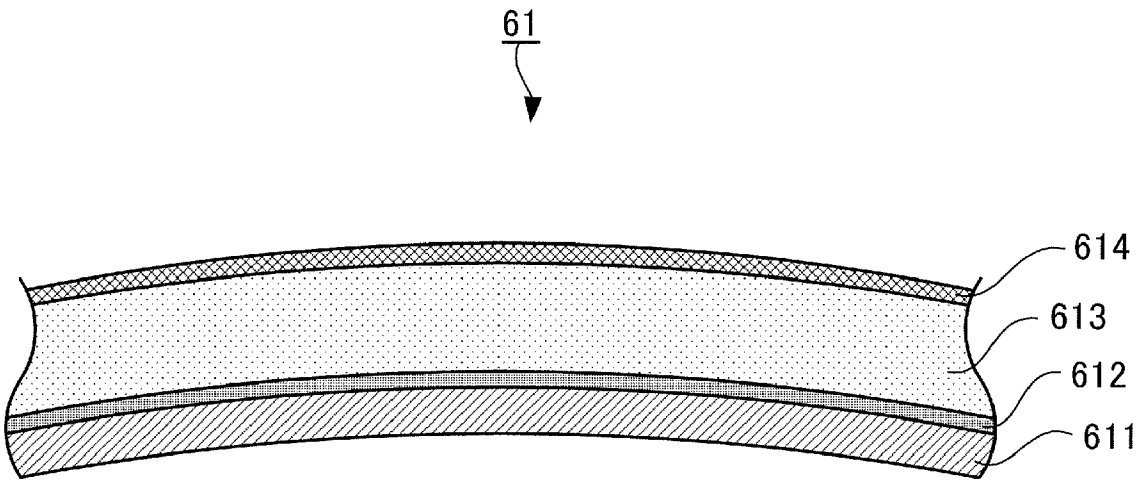
FIG. 4 is a configuration diagram showing cross sectional layers of the fixing belt.

The fixing belt 61 is formed of an endless belt member originally formed into a cylindrical shape, and is formed with a diameter of 30 mm and a width-direction length of 370 mm in the original shape (cylindrical shape), for example. In addition, as shown in FIG. 4 (a configuration diagram showing cross sectional layers of the fixing belt 61), the fixing belt 61 is a belt member having a multi-layer structure including: a base layer 611; a conductive heat-generating layer 612 that is coated on the base layer 611; an elastic layer 613 that improves fixing properties of a toner image; and a surface release layer 614 that is applied as the uppermost layer.

The base layer 611 is formed of a heat-resistant sheet-like member that supports the conductive heat-generating layer 612, which is a thin layer, and that gives a mechanical strength to the entire fixing belt 61. Moreover, the base layer 611 is formed of a specified material with a specified thickness. The base layer material has properties (relative permeability, specific resistance) that allow a magnetic field to pass therethrough so that the AC magnetic field generated at the IH heater 80 may act on the temperature-sensitive magnetic member 64. Meanwhile, the base layer 611 itself is formed so as not to generate heat by action of the magnetic field or not to easily generate heat.

Specifically, for example, a non-magnetic metal such as a non-magnetic stainless steel having a thickness of 30 to 200 μm (preferably, 50 to 150 μm), or a resin material or the like having a thickness of 60 to 200 μm is used as the base layer 611.

The conductive heat-generating layer 612 is an example of a conductive layer and is an electromagnetic induction heat-generating layer that is self-heated by electromagnetic induction of the AC magnetic field generated at the IH heater 80. Specifically, the conductive heat-generating layer 612 is a layer that generates an eddy current when the AC magnetic field from the IH heater 80 passes therethrough in the thickness direction.

Normally, an inexpensively manufacturable general-purpose power supply is used as the power supply for an excitation circuit that supplies an AC current to the IH heater 80 (also refer to later described FIG. 6). For this reason, in general, a frequency of the AC magnetic field generated by the IH heater 80 ranges from 20 kHz to 100 kHz by use of the general-purpose power supply. Accordingly, the conductive heat-generating layer 612 is formed to allow the AC magnetic field having a frequency of 20 kHz to 100 kHz to enter and to pass therethrough.

A region of the conductive heat-generating layer 612, where the AC magnetic field is allowed to enter is defined as a "skin depth (δ)" representing a region where the AC magnetic field attenuates to 1/e. The skin depth (δ) is calculated by use of the following formula (1), where f is a frequency of the AC magnetic field (20 kHz, for example), ρ is a specific resistance value (Ω·m), and $\mu_r$ is a relative permeability.

Accordingly, in order to allow the AC magnetic field having a frequency of 20 kHz to 100 kHz to enter and then to pass through the conductive heat-generating layer 612, the thickness of the conductive heat-generating layer 612 is formed to be smaller than the skin depth (δ) of the conductive heat-generating layer 612, which is defined by the formula (1). In addition, as the material that forms the conductive heat-generating layer 612, a metal such as Au, Ag, Al, Cu, Zn, Sn, Pb, Bi, Be or Sb, or a metal alloy including at least one of these elements is used, for example.

$$\delta = 503\sqrt{\frac{\rho}{f \cdot \mu_r}} \quad (1)$$

Specifically, as the conductive heat-generating layer 612, a non-magnetic metal (a paramagnetic material having a relative permeability substantially equal to 1) including Cu or the like, having a thickness of 2 to 20 μm and a specific resistance value not greater than $2.7\times10^{-8}$ Ω·m is used, for example.

In addition, in view of shortening the period of time required for heating the fixing belt 61 to reach a fixation setting temperature (hereinafter, referred to as a "warm-up time") as well, the conductive heat-generating layer 612 may be formed of a thin layer.

Next, the elastic layer 613 is formed of a heat-resistant elastic material such as a silicone rubber. The toner image to be held on the sheet P, which is to become the fixation target, is formed of a multi-layer of color toner as powder. For this reason, in order to uniformly supply heat to the entire toner image at a nip portion (fixation pressure applying unit) N, the surface of the fixing belt 61 may particularly be deformed so as to correspond with unevenness of the toner image on the sheet P. In this respect, a silicone rubber having a thickness of 100 to 600 μm and a hardness of 10° to 30° (JIS-A), for example, may be used for the elastic layer 613.

The surface release layer 614 directly contacts with an unfixed toner image held on the sheet P. Accordingly, a material with a high releasing property is used. For example, a PFA (a copolymer of tetrafluoroethylene and perfluoroalkylvinylether) layer, a PTFE (polytetrafluoroethylene) layer or a silicone copolymer layer or a composite layer formed of these layers is used. As to the thickness of the surface release layer 614, if the thickness is too small, no sufficient wear resistance is obtained, hence, reducing the life of the fixing belt 61. On the other hand, if the thickness is too large, the heat capacity of the fixing belt 61 becomes so large that the warm-up time becomes longer. In this respect, the thickness of the surface release layer 614 may be particularly 1 to 50 μm in consideration of the balance between the wear resistance and heat capacity.

<Description of Pressing Pad>

The pressing pad 63, which is an example of a pressing member, is formed of an elastic material such as a silicone rubber or fluorine rubber, and is supported by the frame 65 at a position facing the pressing roll 62. Then, the pressing pad 63 is arranged in a state of being pressed by the pressing roll 62 with the fixing belt 61 therebetween, and forms the nip portion N with the pressing roll 62.

In addition, the pressing pad 63 has two different nip pressures set for a pre-nip region **63*a* on the sheet entering side of the nip portion N (upstream side in the transport direction of the sheet P) and a peeling nip region 63*b* on the sheet exit side of the nip portion N (downstream side in the transport direction of the sheet P), respectively. Specifically, a surface of the pre-nip region 63*a* at the pressing roll 62 side is formed into a circular arc shape approximately corresponding with the outer circumferential surface of the pressing roll 62, and the nip portion N, which is uniform and wide, is formed. Moreover, a surface of the peeling nip region 63*b* at the pressing roll 62 side is formed into a shape so as to be locally pressed with a larger nip pressure from the surface of the pressing roll 62 in order that a curvature radius of the fixing belt 61 passing through the nip portion N of the peeling nip region 63*b* may be small. Thereby, a curl (down curl) in a direction in which the sheet P is separated from the surface of the fixing belt 61 is formed on the sheet P passing through the peeling nip region 63*b*, thereby promoting the peeling of the sheet P from the surface of the fixing belt 61**.

Note that, in the present exemplary embodiment, the peeling assisting member 70 is arranged at the downstream side of the nip portion N as an assistance unit for the peeling of the sheet P by the pressing pad 63. In the peeling assisting member 70, a peeling baffle 71 is supported by a frame 72 in a state of being positioned to be close to the fixing belt 61 in a direction opposite to the rotational moving direction of the fixing belt 61 (so-called counter direction). Then, the peeling baffle 71 supports the curl portion formed on the sheet P at the exit of the pressing pad 63, thereby preventing the sheet P from moving toward the fixing belt 61.

<Description of Temperature-Sensitive Magnetic Member>

In the present exemplary embodiment, the temperature-sensitive magnetic member 64 is ferromagnetic within a temperature range not greater than permeability change start temperature. Accordingly, the temperature-sensitive magnetic member 64 starts self-heating by electromagnetic induction heating. The temperature of the fixing belt 61 herein decreases since the fixing belt 61 loses heat when performing fixation. However, the fixing belt 61 may be reheated by the heat generated by this temperature-sensitive magnetic member 64 along with the heat generated from the fixing belt 61 by the electromagnetic induction heating in the same manner. Accordingly, the temperature of the fixing belt 61 may be promptly increased to the fixation setting temperature.

The temperature-sensitive magnetic member 64 is formed into a circular arc shape corresponding with the inner circumferential surface of the fixing belt 61 and arranged to be in contact with the inner circumferential surface of the fixing belt 61. The reason for arranging the temperature-sensitive magnetic member 64 to be in contact with the fixing belt 61 is to allow the heat generated from the temperature-sensitive magnetic member 64 by electromagnetic induction heating to be easily supplied to the fixing belt 61. In addition, the temperature-sensitive magnetic member 64 is kept at the temperature higher than that of the fixing belt 61 by 20 degrees C. to 30 degrees C. in order to supply heat to the fixing belt 61.

Moreover, the temperature-sensitive magnetic member 64 is formed of a material whose "permeability change start temperature" (refer to later part of the description) at which the permeability of the magnetic properties drastically changes is not less than the fixation setting temperature at which each color toner image starts melting, and whose permeability change start temperature is also set within a temperature range lower than the heat-resistant temperatures of the elastic layer 613 and the surface release layer 614 of the fixing belt 61. Specifically, the temperature-sensitive magnetic member 64 is formed of a material having a property ("temperature-sensitive magnetic property") that reversibly changes between the ferromagnetic property and the non-magnetic property (paramagnetic property) in a temperature range including the fixation setting temperature. Thus, the temperature-sensitive magnetic member 64 functions as a magnetic path forming member that forms a magnetic path in the temperature-sensitive magnetic member 64 within the temperature range not greater than the permeability change start temperature. Further, within the temperature range not greater than the permeability change start temperature, where the temperature-sensitive magnetic member 64 has the ferromagnetic property, the temperature-sensitive magnetic member 64 induces magnetic field lines generated by the IH heater 80 and going through the fixing belt 61 to the inside thereof, and forms a magnetic path so that the AC magnetic field (magnetic field lines) may pass through the inside of the temperature-sensitive magnetic member 64. Thereby, the temperature-sensitive magnetic member 64 forms a closed magnetic path that internally wraps the fixing belt 61 and an excitation coil 82 (refer to later-described FIG. 6) of the IH heater 80. Meanwhile, within a temperature range exceeding the permeability change start temperature, the temperature-sensitive magnetic member 64 causes the magnetic field lines generated by the IH heater 80 and going through the fixing belt 61 to go therethrough so as to run across the temperature-sensitive magnetic member 64 in the thickness direction of the temperature-sensitive magnetic member 64. Then, the magnetic field lines generated by the IH heater 80 and going through the fixing belt 61 form a magnetic path in which the magnetic field lines go through the temperature-sensitive magnetic member 64, and then pass through the inside of the induction member 66 and return to the IH heater 80.

Note that, the "permeability change start temperature" herein refers to a temperature at which a permeability (permeability measured by JIS C2531, for example) starts decreasing continuously and refers to a temperature point at which the amount of the magnetic flux (the number of magnetic field lines) going through a member such as the temperature-sensitive magnetic member 64 starts to change, for example. Accordingly, the permeability change start temperature is a temperature close to the Curie point, which is a temperature at which the magnetic property is lost, but is a temperature with a concept different from the Curie point.

Examples of the material of the temperature-sensitive magnetic member 64 include a binary magnetism-adjusted steel such as a Fe—Ni alloy (permalloy) or a ternary magnetism-adjusted steel such as a Fe—Ni—Cr alloy whose permeability change start temperature is set within a range of, for example, 140 degrees C. (the fixation setting temperature) to 240 degrees C. For example, the permeability change start temperature may be set around 225 degrees C. by setting the ratios of Fe and Ni at approximately 64% and 36% (atom number ratio), respectively, in a binary magnetism-adjusted steel of Fe—Ni. The aforementioned metal alloys or the like including the permalloy and the magnetism-adjusted steel are suitable for the temperature-sensitive magnetic member 64 since they are excellent in molding property and processability, and a high heat conductivity as well as less expensive costs. Another example of the material includes a metal alloy made of Fe, Ni, Si, B, Nb, Cu, Zr, Co, Cr, V, Mn, Mo or the like.

In addition, the temperature-sensitive magnetic member 64 is formed with a thickness smaller than the skin depth δ (refer to the formula (1) described above) with respect to the AC magnetic field (magnetic field lines) generated by the IH heater 80. Specifically, a thickness of approximately 50 to 300 μm is set when a Fe—Ni alloy is used as the material, for example.

<Description of Frame>

The frame 65 that supports the pressing pad 63 is formed of a material having a high rigidity so that the amount of deflection in a state where the pressing pad 63 receives pressing force from the pressing roll 62 may be a certain amount or less. In this manner, the amount of pressure (nip pressure) at the nip portion N in the longitudinal direction is kept uniform. Moreover, since the fixing unit 60*a* of the present exemplary embodiment employs a configuration in which the fixing belt 61 is self-heated by use of electromagnetic induction, the frame 65 is formed of a material that provides no influence or hardly provides influence to an induction magnetic field, and that is not influenced or is hardly influenced by the induction magnetic field. For example, a heat-resistant resin such as glass mixed PPS (polyphenylene sulfide), or a paramagnetic metal material such as Al, Cu or Ag is used.

<Description of Induction Member>

In the present exemplary embodiment, the induction member 66 is formed into a circular arc shape corresponding with the inner circumferential surface of the temperature-sensitive magnetic member 64 and arranged to be in contact with the inner circumferential surface of the temperature-sensitive magnetic member 64. Then, when the temperature of the temperature-sensitive magnetic member 64 increases to the permeability change start temperature or higher, the induction member 66 induces the AC magnetic field (magnetic field lines) generated by the IH heater 80 to the inside thereof and forms a state where an eddy current I is easily generated than in the conductive heat-generating layer 612 of the fixing belt 61.

Magnetic field lines H after passing through the temperature-sensitive magnetic member 64 arrive at the induction member 66 and then are induced to the inside thereof. The thickness, material and shape of the induction member 66 are selected for inducing, at this time, most of the magnetic field lines H from the excitation coil 82 to the induction member 66 and suppressing the leak of the magnetic field lines H from the fixing unit 60*a*. Specifically, the induction member 66 may be formed with a thickness set in advance (1.0 mm, for example) sufficiently larger than the skin depth δ (refer to the formula (1) described above) in order to allow the eddy current I to easily flow. Thereby, even when the eddy current I flows into the induction member 66, the amount of heat generated becomes extremely small. In the present exemplary embodiment, the induction member 66 is formed of aluminum (Al) having an approximately circular arc shape along the shape of the temperature-sensitive magnetic member 64 and with a thickness of 1 mm, and is arranged to be in contact with the inner circumferential surface of the temperature-sensitive magnetic member 64. As another example of the material, Ag or Cu may be particularly used.

Moreover, as described above, the induction member 66 has a function to induce the magnetic field lines having passed through the temperature-sensitive magnetic member 64, but also has a function to diffuse the heat generated at the temperature-sensitive magnetic member 64 as well. In actual fixing operations, the size of the sheet P passing through the fixing unit 60 varies. Therefore, the temperature at a portion where the sheet P has passed, of the fixing belt 61 decreases because of loss of heat due to the fixing onto the sheet P. However, the temperature at a portion other than the portion where the sheet P has passed, of the fixing belt 61 does not decrease much. Accordingly, the temperature distribution on the fixing belt 61 becomes non-uniform. For this reason, the non-uniform temperature distribution of the fixing belt 61 may be promptly cancelled and then made uniform by the induction member 66.

<Description of Drive Mechanism of Fixing Belt>

Next, a description will be given of a drive mechanism of the fixing belt 61.

As shown in FIG. 2, which is a front view, end caps 67 are secured to both ends in the axis direction of the frame (refer to FIG. 3), respectively. The end caps 67 rotationally drive the fixing belt 61 in a circumferential direction while keeping cross sectional shapes of both ends of the fixing belt 61 in a circular shape. Then, the fixing belt 61 directly receives rotational drive force via the end caps 67 at the both ends and rotationally moves at, for example, a process speed of 140 mm/s in a direction of an arrow C in FIG. 3.

Figure 5A:
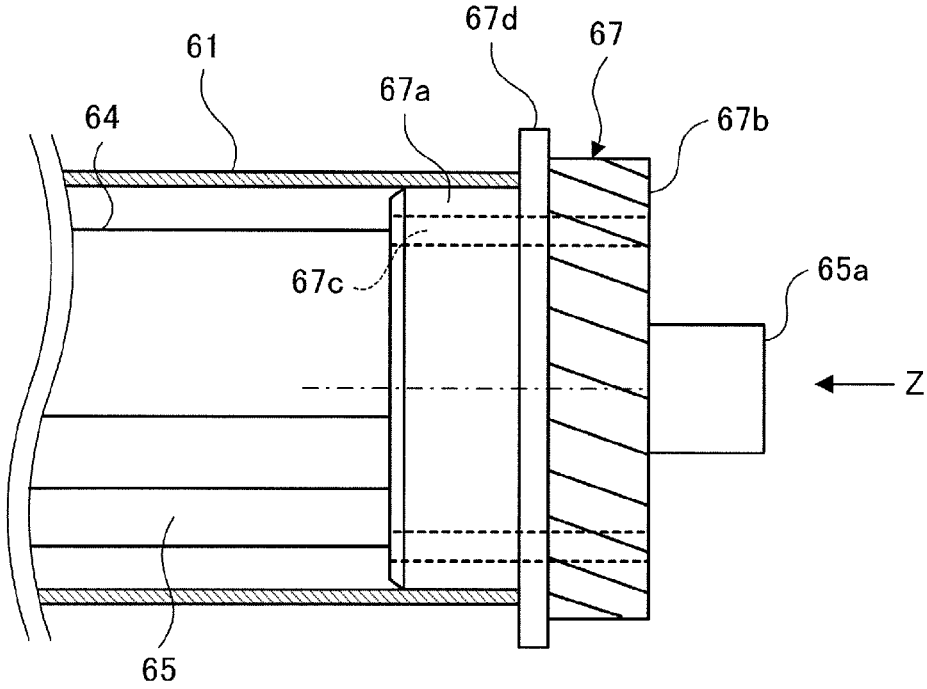
FIG. 5A is a side view of one of the end caps.
Figure 5B:
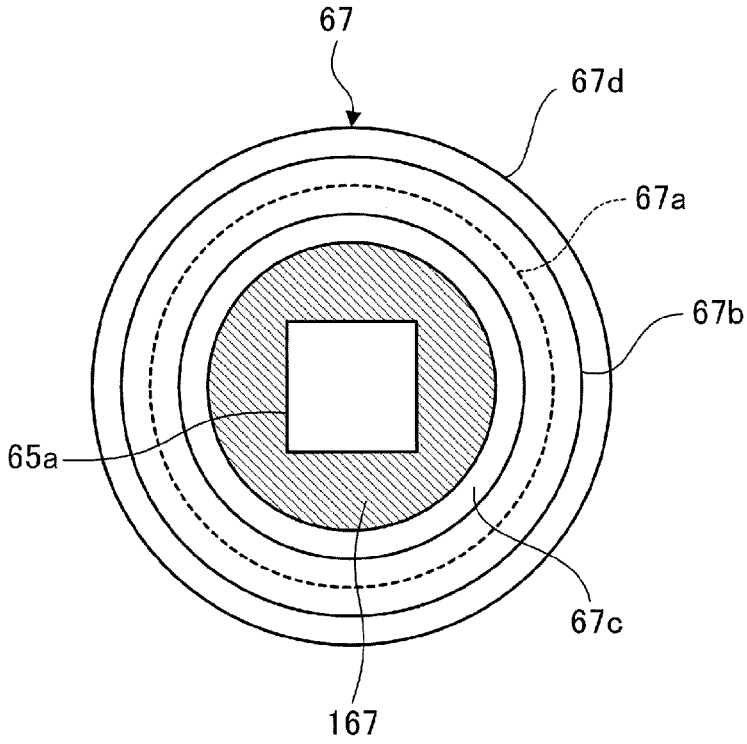
FIG. 5B is a plain view of the end cap when viewed from a Z direction of FIG. 5A.

Here, FIG. 5A is a side view of one of the end caps 67, and FIG. 5B is a plain view of the end cap 67 when viewed from a Z direction of FIG. 5A. As shown in FIGS. 5A and 5B, the end cap 67 includes: a fixing unit 67*a* that is fitted into the inside of a corresponding one of the ends of the fixing belt 61; a flange 67*d* that is formed so as to project from the fixing belt 61 in the radial direction when attached to the fixing belt 61; a gear 67*b* to which the rotational drive force is transmitted; and a bearing unit 67*c* that is rotatably connected to a support member 65*a* formed at a corresponding one of the ends of the frame 65 with a connection member 167 interposed therebetween. Then, as shown in FIG. 2, the support members 65*a* at the both ends of the frame 65 are secured onto the both ends of a chassis 69 of the fixing unit 60*a*, respectively, thereby, supporting the end caps 67 so as to be rotatable with the bearing units 67*c* respectively connected to the support members 65*a*.

As the material of the end caps 67, so called engineering plastics having a high mechanical strength or heat-resistant properties is used. For example, a phenol resin, polyimide resin, polyamide resin, polyamide-imide resin, PEEK resin, PES resin, PPS resin, LCP resin or the like is suitable.

Then, as shown in FIG. 2, in the fixing unit 60*a*, rotational drive force from a drive motor 90 as an example of a drive unit is transmitted to a shaft 93 via transmission gears 91 and 92. The rotational drive force is then transmitted from transmission gears 94 and 95 connected to the shaft 93 to the gears 67*b* of the respective end caps 67 (refer to FIGS. 5A and 5B). Thereby, the rotational drive force is transmitted from the end caps 67 to the fixing belt 61, and the end caps 67 and the fixing belt 61 are integrally driven to rotate.

As described above, the fixing belt 61 directly receives the drive force at the both ends of the fixing belt 61 to rotate, thereby rotating stably.

Here, a torque of approximately 0.1 to 0.5 N·m is generally exerted when the fixing belt 61 directly receives the drive force from the end caps 67 at the both ends thereof and then rotates. However, in the fixing belt 61 of the present exemplary embodiment, the base layer 611 is formed of, for example, a non-magnetic stainless steel having a high mechanical strength. Thus, buckling or the like does not easily occur on the fixing belt 61 even when a torsional torque of approximately 0.1 to 0.5 N·m is exerted on the entire fixing belt 61.

In addition, the fixing belt 61 is prevented from inclining or leaning to one direction by the flanges 67*d* of the end caps 67, but at this time, compressive force of approximately 1 to 5 N is exerted toward the axis direction from the ends (flanges 67*d*) on the fixing belt 61 in general. However, even in a case where the fixing belt 61 receives such compressive force, the occurrence of buckling or the like is prevented since the base layer 611 of the fixing belt 61 is formed of a non-magnetic stainless steel or the like.

As described above, the fixing belt 61 of the present exemplary embodiment receives the drive force directly at the both ends of the fixing belt 61 to rotate, thereby, rotating stably. In addition, the base layer 611 of the fixing belt 61 is formed of, for example, a non-magnetic stainless steel or the like having a high mechanical strength, hence providing the configuration in which buckling or the like caused by a torsion torque or compressive force does not easily occur in this case. Moreover, the softness and flexibility of the entire fixing belt 61 is obtained by forming the base layer 611 and the conductive heat-generating layer 612 respectively as thin layers, so that the fixing belt 61 is deformed so as to correspond with the nip portion N and recovers to the original shape.

With reference back to FIG. 3, the pressing roll 62 is arranged to face the fixing belt 61 and rotates at, for example, a process speed of 140 mm/s in the direction of the arrow D in FIG. 3 while being driven by the fixing belt 61. Then, the nip portion N is formed in a state where the fixing belt 61 is held between the pressing roll 62 and the pressing pad 63. Then, while the sheet P holding an unfixed toner image is caused to pass through this nip portion N, heat and pressure are applied to the sheet P, and thereby, the unfixed toner image is fixed onto the sheet P.

The pressing roll 62 is formed of a multi-layer including: a solid aluminum core (cylindrical core metal) 621 having a diameter of 18 mm, for example; a heat-resistant elastic layer 622 that covers the outer circumferential surface of the core 621, and that is made of silicone sponge having a thickness of 5 mm, for example; and a release layer 623 that is formed of a heat-resistant resin such as PFA containing carbon or the like, or a heat-resistant rubber, having a thickness of 50 μm, for example, and that covers the heat-resistant elastic layer 622. Then, the pressing pad 63 is pressed under a load of 25 kgf for example, by pressing springs 68 (refer to FIG. 2) with the fixing belt 61 therebetween.

<Description of IH Heater>

Next, a description will be given of the IH heater 80 that induces the heat generation of the fixing belt 61 by electromagnetic induction with an action of an AC magnetic field in the conductive heat-generating layer 612 of the fixing belt 61.

Figure 6:
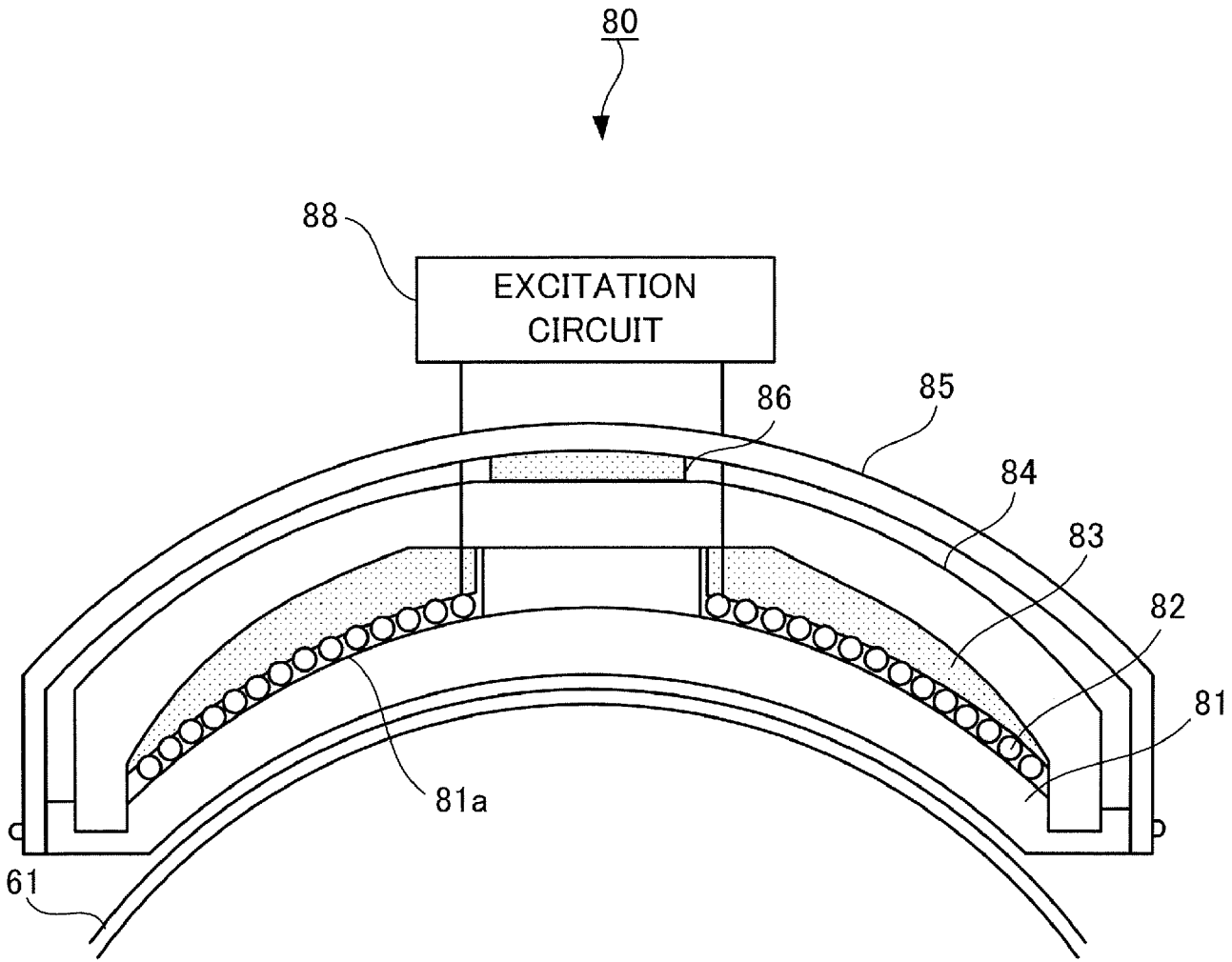
FIG. 6 is a cross sectional view for explaining a configuration of the IH heater.

FIG. 6 is a cross sectional view for explaining a configuration of the IH heater 80 of the exemplary embodiment. As shown in FIG. 6, the IH heater 80 includes: a support body 81 formed of a non-magnetic material such as a heat-resistant resin, for example; and the excitation coil 82 that generates an AC magnetic field. Moreover, the IH heater 80 includes: elastic support members 83 each formed of an elastic material that secures the excitation coil 82 onto the support body 81; and a magnetic core 84 that forms a magnetic path of the AC magnetic field generated at the excitation coil 82. Furthermore, the IH heater 80 includes: a shield 85 that shields a magnetic field; a pressing member 86 that presses the magnetic core 84 toward the support body 81; and an excitation circuit 88 that supplies an AC current to the excitation coil 82.

The support body 81 is formed into a shape in which the cross section thereof is curved along the shape of the surface of the fixing belt 61, and is formed so as to keep a gap set in advance (0.5 to 2 mm, for example) between an upper surface (supporting surface) 81*a* that supports the excitation coil 82 and the surface of the fixing belt 61. In addition, examples of the material that forms the support body 81 include a heat-resistant non-magnetic material such as: a heat-resistant glass; a heat-resistant resin including polycarbonate, polyethersulphone or PPS (polyphenylene sulfide); and the heat-resistant resin containing a glass fiber therein.

The excitation coil 82 is formed by winding a litz wire in a closed loop of an oval shape, elliptical shape or rectangular shape having an opening inside, the litz wire being obtained by bundling 90 pieces of mutually isolated copper wires each having a diameter of 0.17 mm, for example. Then, when an AC current having a frequency set in advance is supplied from the excitation circuit 88 to the excitation coil 82, an AC magnetic field on the litz wire wound in a closed loop shape as the center is generated around the excitation coil 82. In general, a frequency of 20 kHz to 100 kHz, which is generated by the aforementioned general-purpose power supply, is used for the frequency of the AC current supplied to the excitation coil 82 from the excitation circuit 88.

As the material of the magnetic core 84, a ferromagnetic material, formed of an oxide or alloy material with a high permeability, such as a soft ferrite, a ferrite resin, a non-crystalline alloy (amorphous alloy), permalloy or a magnetism-adjusted steel is used. The magnetic core 84 functions as a magnetic path unit. The magnetic core 84 induces, to the inside thereof, the magnetic field lines (magnetic flux) of the AC magnetic field generated at the excitation coil 82, and forms a path (magnetic path) of the magnetic field lines in which the magnetic field lines from the magnetic core 84 run across the fixing belt 61 to be directed to the temperature-sensitive magnetic member 64, then pass through the inside of the temperature-sensitive magnetic member 64, and return to the magnetic core 84. Specifically, a configuration in which the AC magnetic field generated at the excitation coil 82 passes through the inside of the magnetic core 84 and the inside of the temperature-sensitive magnetic member 64 is employed, and thereby, a closed magnetic path where the magnetic field lines internally wrap the fixing belt 61 and the excitation coil 82 is formed. Thereby, the magnetic field lines of the AC magnetic field generated at the excitation coil 82 are concentrated at a region of the fixing belt 61, which faces the magnetic core 84.

Here, the material of the magnetic core 84 may be one that has a small amount of loss due to the forming of the magnetic path. Specifically, the magnetic core 84 may be particularly used in a form that reduces the amount of eddy-current loss (shielding or dividing of the electric current path by having a slit or the like, or bundling of thin plates, or the like). In addition, the magnetic core 84 may be particularly formed of a material having a small hysteresis loss.

The length of the magnetic core 84 along the rotation direction of the fixing belt 61 is formed so as to be shorter than the length of the temperature-sensitive magnetic member 64 along the rotation direction of the fixing belt 61. Thereby, the amount of leakage of the magnetic field lines toward the periphery of the IH heater 80 is reduced, resulting in improvement in the power factor. Moreover, the electromagnetic induction toward the metal materials forming the fixing unit is also suppressed and the heat-generating efficiency at the fixing belt 61 (conductive heat-generating layer 612) increases.

<Description of a State in which Fixing Belt Generates Heat>

Next, a description will be given of a state in which the fixing belt 61 generates heat by use of the AC magnetic field generated by the IH heater 80.

Firstly, as described above, the permeability change start temperature of the temperature-sensitive magnetic member 64 is set within a temperature range (140 to 240 degrees C., for example) where the temperature is not less than the fixation setting temperature for fixing color toner images and not greater than the heat-resistant temperature of the fixing belt 61. Then, when the temperature of the fixing belt 61 is not greater than the permeability change start temperature, the temperature of the temperature-sensitive magnetic member 64 near the fixing belt 61 corresponds to the temperature of the fixing belt 61 and then becomes equal to or lower than the permeability change start temperature. For this reason, the temperature-sensitive magnetic member 64 has a ferromagnetic property at this time, and thus, the magnetic field lines H of the AC magnetic field generated by the IH heater 80 form a magnetic path where the magnetic field lines H go through the fixing belt 61 and thereafter, pass through the inside of the temperature-sensitive magnetic member 64 along a spreading direction. Here, the "spreading direction" refers to a direction orthogonal to the thickness direction of the temperature-sensitive magnetic member 64.

Figure 7:
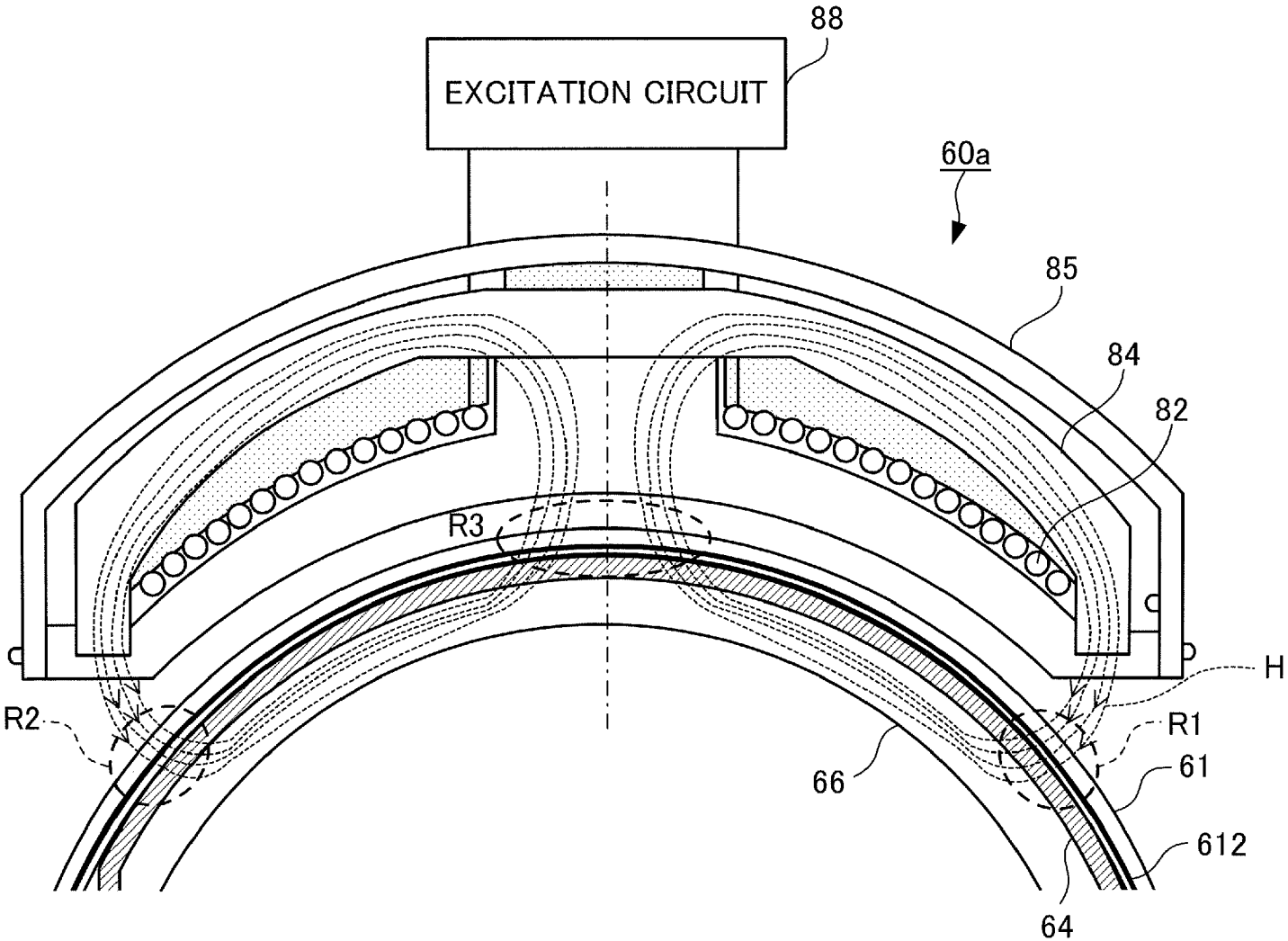
FIG. 7 is a diagram for explaining the state of the magnetic field lines in a case where the temperature of the fixing belt is within the temperature range not greater than the permeability change start temperature.

FIG. 7 is a diagram for explaining the state of the magnetic field lines H in a case where the temperature of the fixing belt 61 is within the temperature range not greater than the permeability change start temperature. As shown in FIG. 7, in the case where the temperature of the fixing belt 61 is within the temperature range not greater than the permeability change start temperature, the magnetic field lines H of the AC magnetic field generated by the IH heater 80 form a magnetic path where the magnetic field lines H go through the fixing belt 61 so as to intersect with the fixing belt 61, and then pass through the inside of the temperature-sensitive magnetic member 64 in the spreading direction (direction orthogonal to the thickness direction). Accordingly, the number of the magnetic field lines H (density of magnetic flux) in unit area in the region where the magnetic field lines H run across the conductive heat-generating layer 612 of the fixing belt 61 becomes large.

Specifically, after the magnetic field lines H are radiated from the magnetic core 84 of the IH heater 80 and pass through regions R1 and R2 where the magnetic field lines H run across the conductive heat-generating layer 612 of the fixing belt 61, the magnetic field lines H are induced to the inside of the temperature-sensitive magnetic member 64, which is a ferromagnetic member. For this reason, the magnetic field lines H running across the conductive heat-generating layer 612 of the fixing belt 61 in the thickness direction are concentrated so as to enter the inside of the temperature-sensitive magnetic member 64. Accordingly, the magnetic flux density becomes high in the regions R1 and R2. In addition, in a case where the magnetic field lines H passing through the inside of the temperature-sensitive magnetic member 64 along the spreading direction return to the magnetic core 84, in a region R3 where the magnetic field lines H run across the conductive heat-generating layer 612 in the thickness direction, the magnetic field lines H are generated toward the magnetic core 84 in a concentrated manner from a portion, where the magnetic potential is low, of the temperature-sensitive magnetic member 64. For this reason, the magnetic field lines H running across the conductive heat-generating layer 612 of the fixing belt 61 in the thickness direction move from the temperature-sensitive magnetic member 64 toward the magnetic core 84 in a concentrated manner, so that the magnetic flux density in the region R3 becomes high as well.

In the conductive heat-generating layer 612 of the fixing belt 61 which the magnetic field lines H run across in the thickness direction, the eddy current I proportional to the amount of change in the number of the magnetic field lines H per unit area (magnetic flux density) is generated. Thereby, as shown in FIG. 7, a larger eddy current I is generated in the regions R1, R2 and R3 where a large amount of change in the magnetic flux density occurs. The eddy current I generated in the conductive heat-generating layer 612 generates a Joule heat W ($W=I^2R$), which is multiplication of the specific resistant value R and the square of the eddy current I of the conductive heat-generating layer 612. Accordingly, a large Joule heat W is generated in the conductive heat-generating layer 612 where the larger eddy current I is generated.

As described above, in a case where the temperature of the fixing belt 61 is within the temperature range not greater than the permeability change start temperature, a large amount of heat is generated in the regions R1, R2 and R3 where the magnetic field lines H run across the conductive heat-generating layer 612, and thereby the fixing belt 61 is heated.

Incidentally, in the fixing unit 60*a* of the present exemplary embodiment, the temperature-sensitive magnetic member 64 is arranged at the inner circumferential surface side of the fixing belt 61 while arranged to be in contact with the fixing belt 61, thereby, providing the configuration in which the magnetic core 84 inducing the magnetic field lines H generated at the excitation coil 82 to the inside thereof, and the temperature-sensitive magnetic member 64 inducing the magnetic field lines H running across and going through the fixing belt 61 in the thickness direction are arranged to be close to each other. For this reason, the AC magnetic field generated by the IH heater 80 (excitation coil 82) forms a loop of a short magnetic path, so that the magnetic flux density and the degree of magnetic coupling in the magnetic path increase. Thereby, heat is more efficiently generated in the fixing belt 61 in a case where the temperature of the fixing belt 61 is within the temperature range not greater than the permeability change start temperature.

<Description of Function for Suppressing Increase in Temperature of Non-Sheet Passing Portion of Fixing Belt>

Next, a description will be given of a function for suppressing an increase in the temperature of a non-sheet passing portion of the fixing belt 61.

Figure 8:
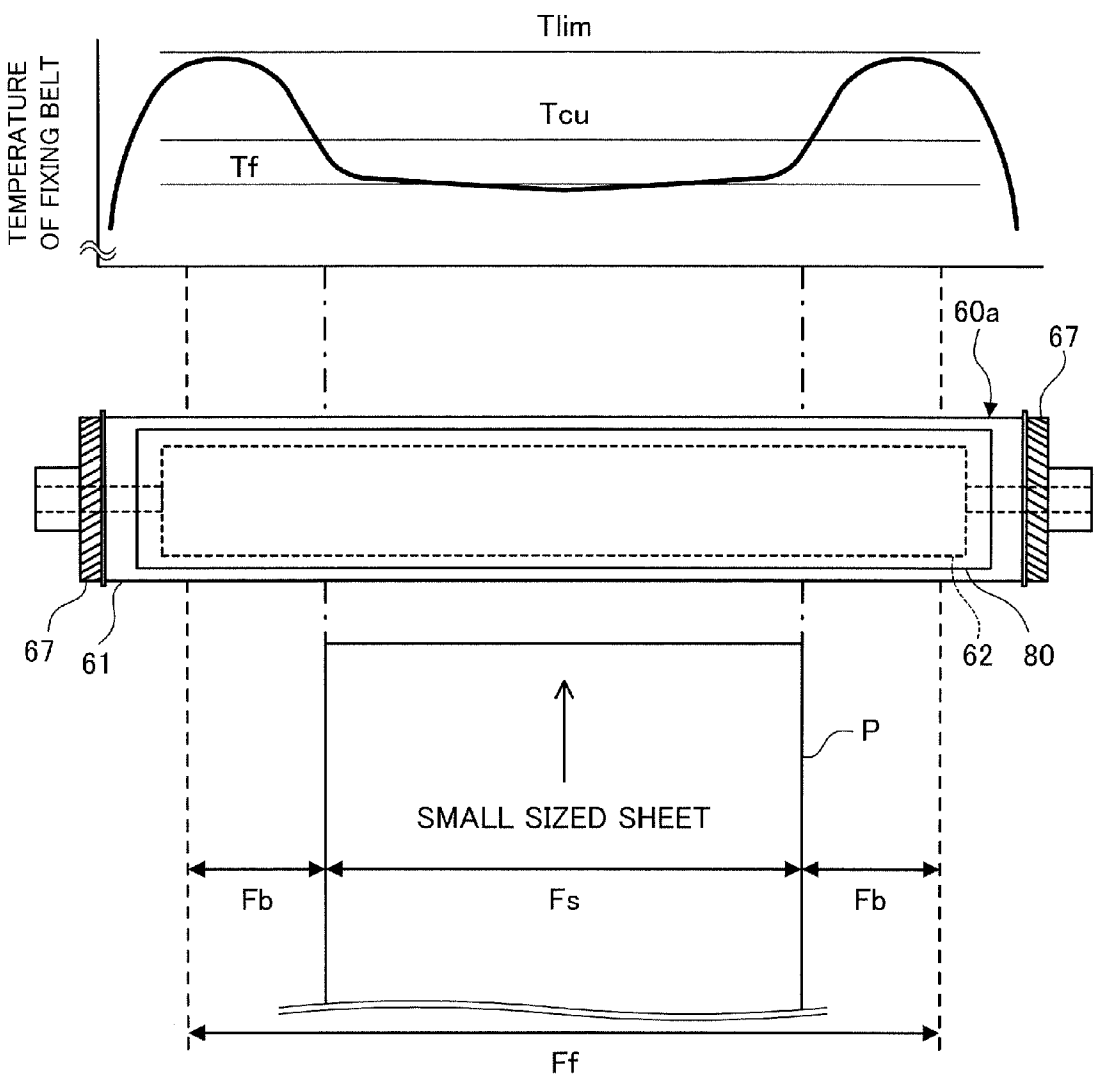
FIG. 8 is a diagram showing a summary of a temperature distribution in the width direction of the fixing belt when the small size sheets are successively inserted into the fixing unit.

Firstly, a description will be given herein of a case where sheets P of a small size (small size sheets P1) are successively inserted into the fixing unit 60*a*. FIG. 8 is a diagram showing a summary of a temperature distribution in the width direction of the fixing belt 61 when the small size sheets P1 are successively inserted into the fixing unit 60. In FIG. 8, Ff denotes a maximum sheet passing region, which is the width (A3 long side, for example) of the maximum size of a sheet P used in the image forming apparatus 1, Fs denotes a region (small size sheet passing region) through which the small size sheet P1 (A4 longitudinal feed, for example) having a smaller horizontal width than that of a maximum size sheet P passes, and Fb denotes a non-sheet passing region through which no small size sheet P1 passes. Note that, sheets are inserted into the image forming apparatus 1 with the center position thereof as the reference point.

As shown in FIG. 8, when the small size sheets P1 are successively inserted into the fixing unit 60, the heat for fixing is consumed at the small size sheet passing region Fs where each of the small size sheets P1 passes. For this reason, the controller 31 (refer to FIG. 1) performs a temperature adjustment control with a fixation setting temperature, so that the temperature of the fixing belt 61 at the small size sheet passing region Fs is maintained within a range near the fixation setting temperature. Meanwhile, at the non-sheet passing regions Fb as well, the same temperature adjustment control as that performed for the small size sheet passing region Fs is performed. However, the heat for fixing is not consumed at the non-sheet passing regions Fb. For this reason, the temperature of the non-sheet passing regions Fb easily increases to a temperature higher than the fixation setting temperature. Then, when the small size sheets P1 are successively inserted into the fixing unit 60 in this state, the temperature of the non-sheet passing regions Fb increases to a temperature higher than the heat-resistant temperature of the elastic layer 613 or the surface release layer 614 of the fixing belt 61, hence deteriorating the fixing belt 61 in some cases.

In this respect, as described above, in the fixing unit 60*a* of the present exemplary embodiment, the temperature-sensitive magnetic member 64 is formed of, for example, a Fe—Ni alloy or the like whose permeability change start temperature is set within a temperature range not less than the fixation setting temperature and not greater than the heat-resistant temperature of the elastic layer 613 or the surface release layer 614 of the fixing belt 61. Specifically, as shown in FIG. 8, a permeability change start temperature Tcu of the temperature-sensitive magnetic member 64 is set within a temperature range not less than a fixation setting temperature Tf and not greater than a heat-resistant temperature Tlim of, for example, the elastic layer 613 or the surface release layer 614.

Thus, when the small size sheets P1 are successively inserted into the fixing unit 60, the temperature of the non-sheet passing regions Fb of the fixing belt 61 exceeds the permeability change start temperature of the temperature-sensitive magnetic member 64. Accordingly, the temperature of the temperature-sensitive magnetic member 64 near the fixing belt 61 at the non-sheet passing regions Fb also exceeds the permeability change start temperature in response to the temperature of the fixing belt 61 as in the case of the fixing belt 61. For this reason, the relative permeability of the temperature-sensitive magnetic member 64 at the non-sheet passing regions Fb becomes close to 1, so that the temperature-sensitive magnetic member 64 at the non-sheet passing regions Fb loses ferromagnetic properties. Since the relative permeability of the temperature-sensitive magnetic member 64 decreases and becomes closer to 1, the magnetic field lines H at the non-sheet passing regions Fb are no longer induced to the inside of the temperature-sensitive magnetic member 64, and start going through the temperature-sensitive magnetic member 64. For this reason, in the fixing belt 61 at the non-sheet passing regions Fb, the magnetic field lines H spread after passing through the conductive heat-generating layer 612, hence leading to a decrease in the density of magnetic flux of the magnetic field lines H running across the conductive heat-generating layer 612. Thereby, the amount of an eddy current I generated at the conductive heat-generating layer 612 decreases, and then, the amount of heat (Joule heat W) generated at the fixing belt 61 decreases. As a result, an excessive increase in the temperature at the non-sheet passing regions Fb is suppressed, and the fixing belt 61 is prevented from being damaged.

As described above, the temperature-sensitive magnetic member 64 functions as a detector that detects the temperature of the fixing belt 61 and also functions as a temperature increase suppresser that suppresses an excessive increase in the temperature of the fixing belt 61 in accordance with the detected temperature of the fixing belt 61, at a time.

The magnetic field lines H passing through the temperature-sensitive magnetic member 64 arrive at the induction member 66 (refer to FIG. 3) and then are induced to the inside thereof. When the magnetic flux arrives at the induction member 66 and then is induced to the inside thereof, a large amount of the eddy current I flows into the induction member 66, into which the eddy current I flows more easily than into the conductive heat-generating layer 612. Thus, the amount of eddy current flowing into the conductive heat-generating layer 612 is further suppressed, so that an increase in the temperature at the non-sheet passing regions Fb is suppressed.

At this time, the thickness, material and shape of the induction member 66 are selected in order that the induction member 66 may induce most of the magnetic field lines H from the excitation coil 82 and the magnetic field lines H may be prevented from leaking from the fixing unit 60*a*. Specifically, the induction member 66 is formed of a material having a sufficiently large thickness of the skin depth δ. Thereby, even when the eddy current I flows into the induction member 66, the amount of heat to be generated is extremely small. In the present exemplary embodiment, the induction member 66 is formed of Al (aluminum), with a thickness of 1 mm, of a substantially circular arc shape along the temperature-sensitive magnetic member 64. The induction member 66 is also arranged so as not to be in contact with the temperature-sensitive magnetic member 64 (average distance therebetween is 4 mm, for example). As another example of the material, Ag or Cu may be particularly used.

Incidentally, when the temperature of the fixing belt 61 at the non-sheet passing regions Fb becomes lower than the permeability change start temperature of the temperature-sensitive magnetic member 64, the temperature of the temperature-sensitive magnetic member 64 at the non-sheet passing regions Fb also becomes lower than the permeability change start temperature thereof. For this reason, the temperature-sensitive magnetic member 64 becomes ferromagnetic again, and the magnetic field lines H are induced to the inside of the temperature-sensitive magnetic member 64. Thus, a large amount of the eddy current I flows into the conductive heat-generating layer 612. For this reason, the fixing belt 61 is again heated.

Figure 9:
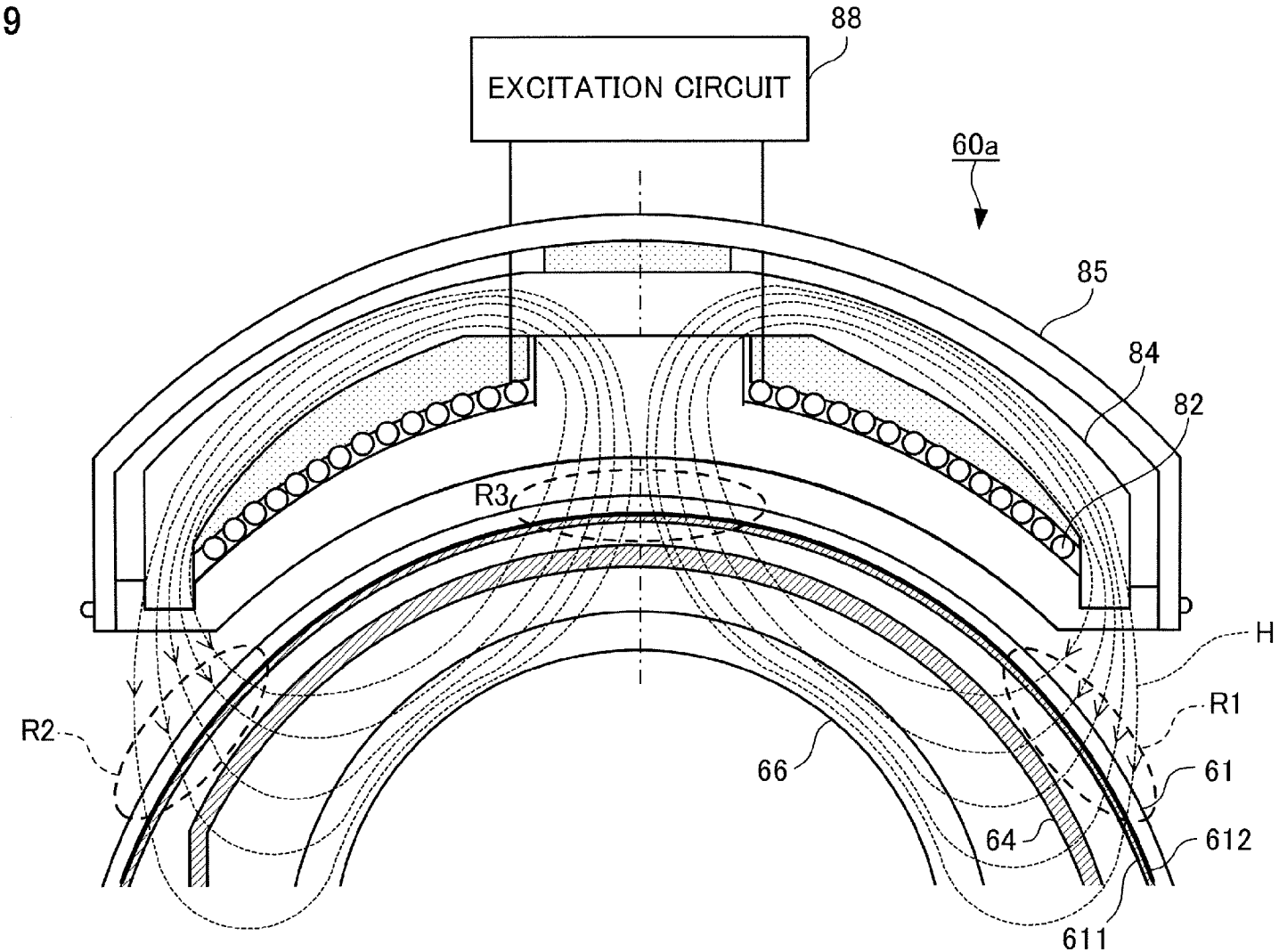
FIG. 9 is a diagram for explaining a state of the magnetic field lines when the temperature of the fixing belt at the non-sheet passing regions is within the temperature range exceeding the permeability change start temperature.

FIG. 9 is a diagram for explaining a state of the magnetic field lines H when the temperature of the fixing belt at the non-sheet passing regions Fb is within the temperature range exceeding the permeability change start temperature. As shown in FIG. 9, when the temperature of the fixing belt 61 at the non-sheet passing regions Fb is within the temperature range exceeding the permeability change start temperature, the relative permeability of the temperature-sensitive magnetic member 64 at the non-sheet passing regions Fb decreases. For this reason, the magnetic field lines H of the AC current generated by the IH heater changes so as to easily go through the temperature-sensitive magnetic member 64. Thereby, the magnetic field lines H of the AC current generated by the IH heater 80 (excitation coil 82) are radiated from the magnetic core 84 so as to spread toward the fixing belt 61 and arrive at the induction member 66.

Specifically, at the regions R1 and R2 where the magnetic field lines H are radiated from the magnetic core 84 of the IH heater 80 and then run across the conductive heat-generating layer 612 of the fixing belt 61, since the magnetic field lines H are not easily induced to the temperature-sensitive magnetic member 64, the magnetic field lines H radially spread. Accordingly, the density of the magnetic flux (the number of the magnetic field lines H per unit area) of the magnetic field lines H running across the conductive heat-generating layer 612 of the fixing belt 61 in the thickness direction decreases. In addition, at the region R3 where the magnetic field lines H run across the conductive heat-generating layer 612 in the thickness direction when returning to the magnetic core 84 again, the magnetic field lines H return to the magnetic core 84 from the wide region where the magnetic field lines H spread, so that the density of the magnetic flux of the magnetic field lines H running across the conductive heat-generating layer 612 of the fixing belt 61 in the thickness direction decreases.

For this reason, when the temperature of the fixing belt 61 is within the temperature range exceeding the permeability change start temperature, the density of the magnetic flux of the magnetic field lines H running across the conductive heat-generating layer 612 in the thickness direction at the regions R1, R2 and R3 decreases. Accordingly, the amount of the eddy current I generated in the conductive heat-generating layer 612 where the magnetic field lines H run across in the thickness direction decreases, and the Joule heat W generated at the fixing belt 61 decreases. Therefore, the temperature of the fixing belt 61 decreases.

As described above, when the temperature of the fixing belt 61 at the non-sheet passing regions Fb is within a temperature range not less than the permeability change start temperature, the magnetic field lines H are not easily induced to the inside of the temperature-sensitive magnetic member 64 at the non-sheet passing regions Fb. Thus, the magnetic field lines H of the AC magnetic field generated by the excitation coil 82 spread and run across the conductive heat-generating layer 612 of the fixing belt 61 in the thickness direction. Accordingly, the magnetic path of the AC magnetic field generated by the excitation coil 82 forms a long loop, so that the density of magnetic flux in the magnetic path in which the magnetic field lines H pass through the conductive heat-generating layer 612 of the fixing belt 61 decreases.

Thereby, at the non-sheet passing regions Fb where the temperature thereof increases, for example, when the small size sheets P1 are successively inserted into the fixing unit 60, the amount of the eddy current I generated at the conductive heat-generating layer 612 of the fixing belt 61 decreases, and the amount of heat (Joule heat W) generated at the non-sheet passing regions Fb of the fixing belt 61 decreases. As a result, an excessive increase in the temperature of the non-sheet passing regions Fb is suppressed.

<Description of Configuration for Suppressing Increase in Temperature of Temperature-Sensitive Magnetic Member>

In order for the temperature-sensitive magnetic member 64 to satisfy the aforementioned function to suppress an excessive increase in the temperature at the non-sheet passing regions Fb, the temperature of each region of the temperature-sensitive magnetic member 64 in the longitudinal direction needs to change in accordance with the temperature of each region of the fixing belt 61 in the longitudinal direction, which faces each region of the temperature-sensitive magnetic member 64 in the longitudinal direction, to satisfy the aforementioned function as a detector that detects the temperature of the fixing belt 61.

For this reason, as the configuration of the temperature-sensitive magnetic member 64, a configuration in which the temperature-sensitive magnetic member 64 is not easily subjected to induction heating by the magnetic field lines H is employed. Specifically, even when the temperature-sensitive magnetic member 64 is in a state of being ferromagnetic since the temperature of the fixing belt is not greater than the permeability change start temperature, some of the magnetic field lines H that run across the temperature-sensitive magnetic member 64 in the thickness direction still exist in the magnetic field lines H from the IH heater 80. Thus, a weak eddy current I is generated inside the temperature-sensitive magnetic member 64, so that a small amount of heat is generated in the temperature-sensitive magnetic member 64 as well. For this reason, for example, in a case where a huge amount of image formation is successively performed, the heat is accumulated in the temperature-sensitive magnetic member 64, and the temperature of the temperature-sensitive magnetic member 64 at the sheet passing region (refer to FIG. 8) tends to increase. Thereby, if a material having a large eddy-current loss and hysteresis loss and easily generating heat by the magnetic field lines H passing therethrough is used as that of the temperature-sensitive magnetic member 64, the temperature-sensitive magnetic member 64 may function to suppress an increase in the temperature of the fixing belt 61 at the sheet passing region in some situations, even though the temperature of the fixing belt 61 does not exceed the permeability change start temperature. In this respect, in order to maintain the correspondence relationship between the respective temperatures of the temperature-sensitive magnetic member 64 and the fixing belt 61 and in order for the temperature-sensitive magnetic member 64 to function as the detector that detects the temperature of the fixing belt 61 with high accuracy, Joule heat W to be generated in the temperature-sensitive magnetic member 64 needs to be suppressed.

With this respect, firstly, a material having properties (specific resistance and permeability) not easily subjected to induction heating by the magnetic field lines H is selected as the material of the temperature-sensitive magnetic member 64 for the purpose of reducing an eddy current loss or hysteresis loss in the temperature-sensitive magnetic member 64.

Secondly, the thickness of the temperature-sensitive magnetic member 64 is formed to be larger than the skin depth δ in the state where the temperature-sensitive magnetic member 64 is ferromagnetic, in order that the magnetic field lines H may not easily run across the temperature-sensitive magnetic member 64 in the thickness direction when the temperature of the temperature-sensitive magnetic member 64 is at least within the temperature range not greater than the permeability change start temperature.

Thirdly, multiple slits 64*s* each dividing the flow of the eddy current I generated by the magnetic field lines H are formed in the temperature-sensitive magnetic member 64 (refer to FIG. 10). Even when the material and the thickness of the temperature-sensitive magnetic member 64 are selected so as not to be easily subjected to induction heating, it is difficult to make the eddy current I generated inside the temperature-sensitive magnetic member 64 be zero (0). In this respect, the amount of eddy current I is decreased by dividing the flow of the eddy current I generated in the temperature-sensitive magnetic member 64 with the multiple slits 64*s*. Thereby, Joule heat W generated in the temperature-sensitive magnetic member 64 is suppressed to be low.

Figure 10A:
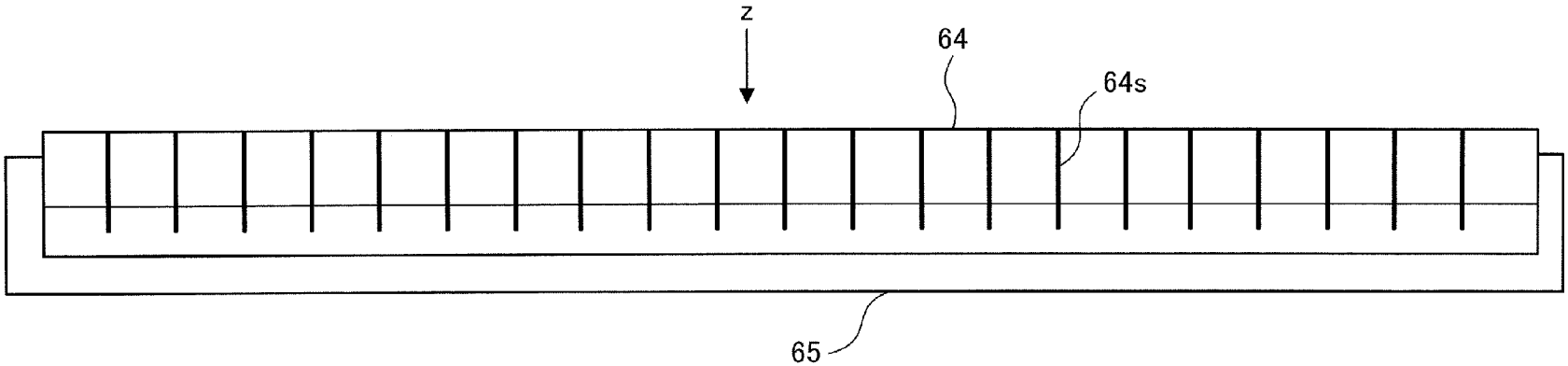
FIGS. 10A and 10B are diagrams showing slits formed in the temperature-sensitive magnetic member.
Figure 10B:
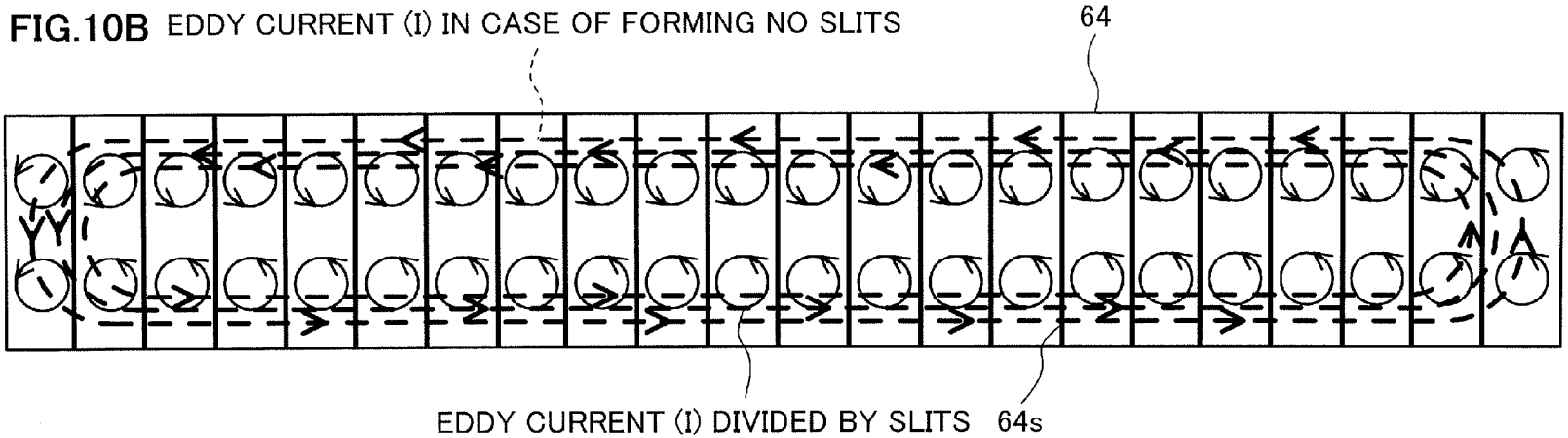

FIGS. 10A and 10B are diagrams showing slits formed in the temperature-sensitive magnetic member 64. FIG. 10A is a side view showing a state where the temperature-sensitive magnetic member 64 is mounted on the frame (holder) 65. FIG. 10B is a plain view showing a state when FIG. 10A is viewed from above (z direction). As shown in FIGS. 10A and 10B, the multiple slits 64*s* are formed in a direction orthogonal to the direction of the flow of the eddy current I generated by the magnetic field lines H, in the temperature-sensitive magnetic member 64. Thereby, the eddy current I (shown by broken lines in FIG. 10B), which flows in the entire temperature-sensitive magnetic member 64 in the longitudinal direction while forming a large swirl in a case of forming no slits 64*s*, is divided by the slits 64*s*. Accordingly, in a case where the slits 64*s* are formed, the eddy current I (shown by a solid line in FIG. 10A) that flows in the temperature-sensitive magnetic member 64 becomes small swirls each being in a region formed between adjacent two of the slits 64*s*, hence reducing the entire amount of the eddy current I. As a result, the amount of heat (Joule heat W) generated in the temperature-sensitive magnetic member 64 decreases. Thereby, the configuration in which heat is not easily generated is achieved. Accordingly, each of the multiple slits 64*s* functions as an eddy current dividing unit that divides the eddy current I.

Note that, the slits 64*s* are formed in the direction orthogonal to the direction of the flow of the eddy current I in the temperature-sensitive magnetic member 64 exemplified in FIGS. 10A and 10B. However, as long as the configuration allows the slits 64*s* to divide the flow of the eddy current I, slits inclined with respect to the direction of the flow of the eddy current I may be formed, for example. Moreover, other than the configuration as shown in FIGS. 10A and 10B in which the slits 64*s* are formed over the entire region in the width direction of the temperature-sensitive magnetic member 64, slits may be partially formed in the width direction of the temperature-sensitive magnetic member 64. Furthermore, the number of, the position of or the inclination angle of slits may be configured in accordance with the amount of heat to be generated in the temperature-sensitive magnetic member 64.

In addition, slits may be formed in the temperature-sensitive magnetic member 64 in a way that the temperature-sensitive magnetic member 64 is divided into a group of small pieces by the slits with an inclination angle of each slit being the maximum. The effects of the present invention may be obtained in this configuration as well.

With reference back to FIG. 3, the heat-resistant elastic layer 622 and the release layer 623 of the pressing roll 62, except the core 621, are formed of relatively soft materials as described above. For this reason, if the pressing roll 62 is left in a state where the pressing roll 62 presses the pressing pad 63 with the fixing belt 61 therebetween as shown in FIG. 3 even when fixation is not performed, the pressing roll 62 may become unrecoverable to the original shape. Specifically, the pressing roll 62 deforms and remains in a shape formed by the nip portion N. In this case, the amount of pressing force applied to the nip portion N becomes different from the originally designed amount. Thus, the fixation is not performed in accordance with the specification, which results in loss of performance of the fixing unit 60*a*.

[Description of Moving Mechanism of Pressing Roll]

Accordingly, in order to prevent the occurrence of the aforementioned case, a moving mechanism not shown in the figure is provided to the pressing roll 62, and an operation to separate the pressing roll 62 from the fixing belt 61 is performed during a period other than when fixation is performed. Specifically, when fixation is performed, the pressing roll 62 is brought into contact with and pressed against an outer circumferential surface of the fixing belt 61 and forms the nip portion N for inserting a recording medium P holding an unfixed toner image thereon between the pressing roll 62 and the fixing belt 61. On the other hand, when fixation is not performed, the pressing roll 62 moves so as to separate from the fixing belt 61.

Figure 11:
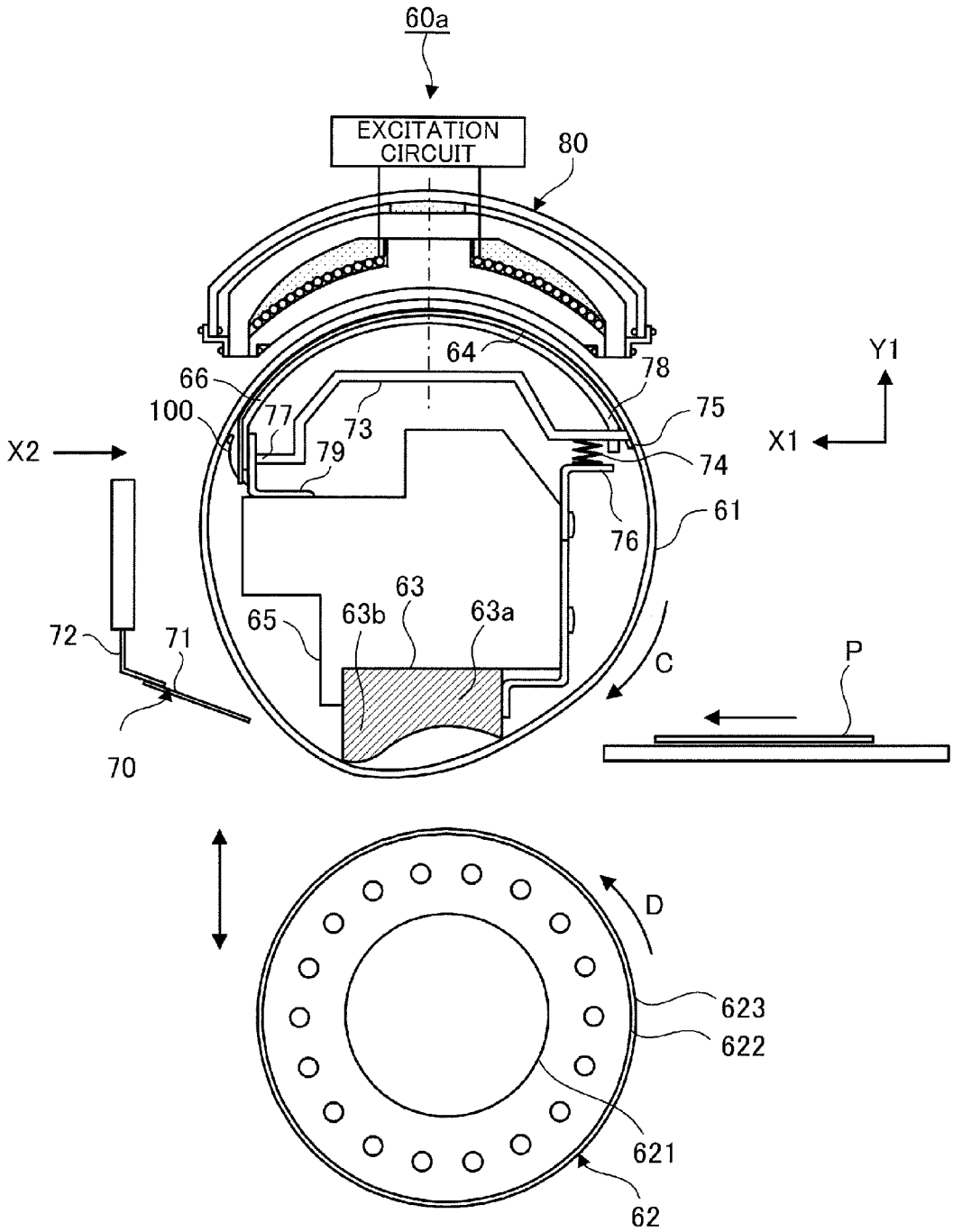
FIG. 11 is a diagram for explaining the state in which the pressing roll is separated from the fixing belt by the moving mechanism.

FIG. 11 is a diagram for explaining the state in which the pressing roll 62 is separated from the fixing belt 61 by the moving mechanism.

As shown in FIG. 11, the pressing roll 62 and the fixing belt 61 are in the state of being separated from each other. As a result, the shape of the pressing roll 62 recovers to the original circular shape, so that the pressing roll 62 is less likely to deform and to become unrecoverable to the original shape.

Note that, when fixation is performed, the pressing roll 62 may be brought into contact with the fixing belt 61 again by the moving mechanism, and return to the position to form the nip portion N as described in FIG. 3.

Here, in the state where the pressing roll 62 is separated from the fixing belt 61 as shown in FIG. 11, normally, the shape of the fixing belt 61 is in an elliptical shape. On the other hand, the shape of the fixing belt 61 described in FIG. 3 is in substantially a circular shape. Specifically, the shape of the fixing belt 61 repeatedly changes between the elliptical shape and the approximately circular shape because of repeating operation in which the pressing roll 62 and the fixing belt 61 are brought into contact with each other and then are separated from each other by the moving mechanism. In this case, an edge 75 on the downstream side of the temperature-sensitive magnetic member 64 in the rotational direction of the fixing belt 61 is brought into contact with the fixing belt 61 and then separates from the fixing belt 61, and the above operation is repeatedly performed. As a result, an inner surface of the fixing belt 61 may be damaged and broken. In a case where the inner surface of the fixing belt 61 is damaged, the damage may further spread, hence causing a crack on the conductive heat-generating layer 612 (refer to FIG. 4) in some cases. If the fixing belt 61 is damaged in the aforementioned manner, the fixing belt 61 does not generate heat in accordance with the designed specification. Moreover, distribution of the heat on the fixing belt 61 becomes non-uniform.

In order to prevent the fixing belt 61 from being broken in the above described manner, it is conceivable to move and arrange the position of the temperature-sensitive magnetic member 64 to a lower position in FIGS. 3 and 11. In this case, the fixing belt 61 is prevented from being in contact with the edge 75 of the temperature-sensitive magnetic member 64. However, the degree of contact between the temperature-sensitive magnetic member 64 and the fixing belt 61 becomes weak in this case, so that the heat generated at the temperature-sensitive magnetic member 64 is not easily transmitted to the fixing belt 61. For this reason, it becomes difficult to maintain the temperature of the fixing belt 61 and also to maintain the uniformity of the temperature distribution.

In this respect, an elastic member 74 is provided in the present exemplary embodiment, and the state in which the temperature-sensitive magnetic member 64 and the fixing belt 61 are in contact with each other is kept by pressing the temperature-sensitive magnetic member 64 against the fixing belt 61 with the pressing effect exerted by this elastic member 74, thereby, addressing this problem.

<Description of Elastic Member>

Hereinafter, a description will be given of the elastic member 74 and the effects thereof in more details.

As shown in FIGS. 3 and 11, the elastic member 74 is arranged between an elastic member holder 76 and the magnetic path shielding member 73. In addition, an edge 77, which is one edge of the magnetic path shielding member 73, is secured by a fixing holder 79 attached to the frame 65. That is, the edge thereof on the sheet exit side is secured. The fixing holder 79 also secures one edge of each of the temperature-sensitive magnetic member 64 and the induction member 66, the one edge being positioned on the upstream side in the rotational direction of the fixing belt 61, that is, on the sheet exit side. Then, the other edge 78 of the magnetic path shielding member 73 is connected to the temperature-sensitive magnetic member 64 and the induction member 66.

In this configuration, since the magnetic path shielding member 73 is formed of aluminum or the like and is elastic, the edge 78 is vertically movable with respect to the edge 77 as the supporting point. In addition, the elastic member 74 generates force in a Y1 direction, which is an upper direction when viewed in FIGS. 3 and 11. With this force, the magnetic path shielding member 73 on the edge 78 side moves up in the Y1 direction. Since the magnetic path shielding member 73, the temperature-sensitive magnetic member 64 and the induction member 66 are connected to one another at the portion of the edge 78 of the magnetic path shielding member 73, the force generated by the elastic member 74 is exerted as force to press the temperature-sensitive magnetic member 64 and the induction member 66 in a direction toward the fixing belt 61. As a result, the temperature-sensitive magnetic member 64 is in a state of being pressed against the fixing belt 61. Specifically, even if the pressing roll 62 is brought into contact with the fixing belt 61 and separated from the fixing belt 61, by the moving mechanism, and this operation is repeated as described above, the temperature-sensitive magnetic member 64 is kept in the state of being pressed against the fixing belt 61. For this reason, the change in the shape of the fixing belt 61 is subtle, and the shape thereof is kept in an approximately circular shape. As a result, the state in which the fixing belt 61 and the temperature-sensitive magnetic member 64 are in contact with each other does not easily change. Accordingly, breaking of the fixing belt 61 stemming from damage on the inner surface of the fixing belt 61 at the edge 75 of the temperature-sensitive magnetic member 64 does not easily occur. Furthermore, the induction member 66 as well moves in a direction of the pressing force applied thereto by the temperature-sensitive magnetic member 64, and thus, the state in which the temperature-sensitive magnetic member 64 and the induction member 66 are in contact with each other does not easily change. For this reason, the state of the formation of the magnetic path does not easily change, and also, the thermal diffusion effect exerted by the induction member 66 does not easily change. Accordingly, even in the state where the pressuring roll 62 is separated from the fixing belt 61 or brought into contact with the fixing belt 61, by the moving mechanism, the state where the fixing belt 61, the temperature-sensitive magnetic member 64 and the induction member 66 are mutually in contact with one another is kept. As a result, when the pressing roll 62 returns to the state of being in contact with the fixing belt 61 by the moving mechanism for performing a fixing operation, the state in which the heat generated by the temperature-sensitive magnetic member 64 is supplied to the fixing belt 61 does not easily change, hence allowing the fixing operation to be started promptly.

Moreover, since the state in which the fixing belt 61, the temperature-sensitive magnetic member 64 and the induction member 66 are mutually in contact with one another is kept, the heat does not easily spread outside. Accordingly, the temperatures of the fixing belt 61, the temperature-sensitive magnetic member 64 and the induction member 66 do not easily change even when the fixing operation is not performed. For this reason, with this point as well, not only the fixing operation is started promptly, but also energy saving is achievable. Moreover, a stable operation of the fixing unit 60*a* is achieved, hence providing the image forming apparatus 1 (refer to FIG. 1) capable of maintaining a higher quality image.

Note that, the elastic member 74 is not limited to any particular member, and a plate spring, coil spring or the like may be used as the elastic member 74. However, a coil spring may be particularly used since coil springs are easily assembled, and allow freedom in design. In addition, the attached position of the elastic member 74 is not limited to any particular position as long as the position allows the elastic member 74 to press the temperature-sensitive magnetic member 64 and the induction member 66 toward the fixing belt 61. Note that, it is at the downstream side in the rotational direction of the fixing belt 61 that the shape of the fixing belt 61 is likely to change when the pressing roll 62 is separated from the fixing belt 61 by the aforementioned moving mechanism. In addition, for preventing the fixing belt 61 from being broken by the aforementioned edge 75 on the downstream side of the temperature-sensitive magnetic member 64, the elastic member 74 may be particularly arranged at the edge 75 of the temperature-sensitive magnetic member 64 or a position adjacent to the edge 75 on the downstream side thereof in the rotational direction of the fixing belt 61.

In addition, in the aforementioned example, the edge 77, which is one edge of the magnetic path shielding member 73, is secured. However, the present exemplary embodiment is not limited to a case where the edge 77 is completely secured by adhesion, welding, screw fastening or the like, but includes a case where the edge 77 is secured by fitting or the like with some margin. In this case, the assembly is likely to be easier.

Figure 12:
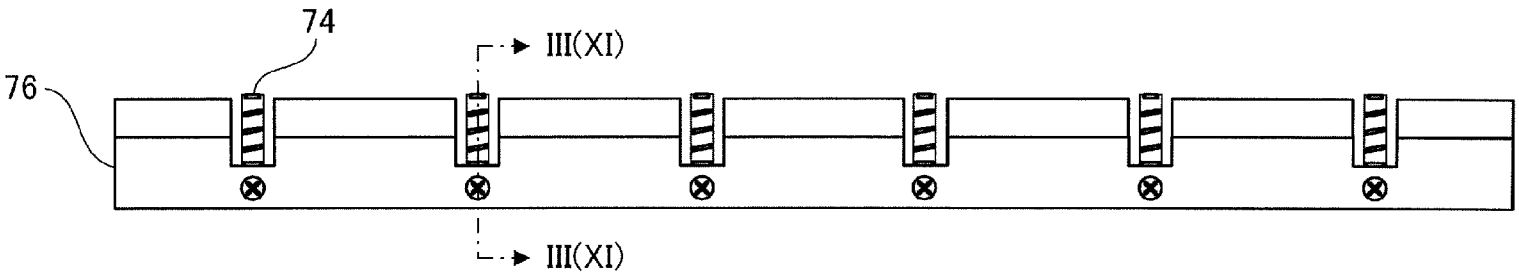
FIG. 12 is a diagram showing the portions of the elastic member holder and the elastic member when viewed in an X1 direction in FIGS. 3 and 11.

FIG. 12 is a diagram showing the portions of the elastic member holder 76 and the elastic member 74 when viewed in an X1 direction in FIGS. 3 and 11. Here, for the purpose of simplifying the description, the temperature-sensitive magnetic member 64, the induction member 66 and the like are not illustrated. Note that, FIGS. 3 and 11 show the elastic member holder 76 and the elastic member 74 when viewed in a III(XI)-III(XI) cross section in FIG. 12.

In the example shown in FIG. 12, a coil spring is used as the elastic member 74. Multiple coil springs are arranged on the elastic member holder 76 in the rotational axis direction of the fixing belt 61. In the example shown in FIG. 12, six coil springs each being as the elastic member 74 are provided and arranged at approximately equal intervals. When the multiple coil springs are provided in this manner, large force may be generated with a small amount of displacement even in a case where small coil springs need to be used due a limitation of the attachment space. Moreover, when the coil springs are arranged in such a distributed manner, the force may be generated more uniformly. For this reason, the temperature-sensitive magnetic member 64 and the induction member 66 may be more smoothly moved in a direction to press them toward the fixing belt 61.

<Description of Temperature Sensor>

Next, a description will be given of the temperature sensor 100 in detail.

Figure 13A:
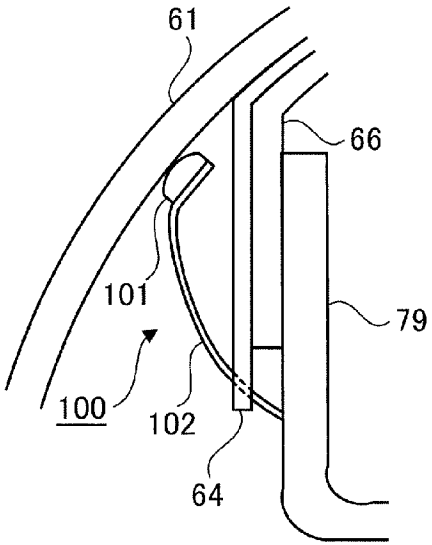
FIG. 13A is an enlarged view showing the position where the temperature sensor is attached in FIGS. 3 and 11.

FIG. 13A is an enlarged view showing the position where the temperature sensor 100 is attached in FIGS. 3 and 11.

The temperature sensor 100 exemplified in FIG. 13A is a thermistor-type temperature sensor and includes: a temperature detector (temperature detection unit, thermistor) 101 having a thermistor that is a material whose resistance changes in accordance with a temperature change; and a support portion (biasing member) 102 that is used for attaching the temperature sensor 100 to the fixing unit 60*a*.

As a thermistor used as the temperature detector 101, the following various thermistors are usable: a negative temperature coefficient (NTC) thermistor whose resistance decreases according to a temperature increase; a positive temperature coefficient (PTC) thermistor whose resistance increases according to a temperature increase; and a critical temperature resistor (CTR) thermistor whose resistance decreases according to a temperature increase but whose sensitivity increases within a specific temperature range. However, the NTC thermistor may be particularly used since the NTC thermistor has a proportional relationship between changes in temperature and resistance, and is suitable for detecting temperature. Examples of the NTC thermistor include a sintered body obtained by mixing and sintering oxides such as oxides of nickel, manganese, cobalt, and iron.

In the present exemplary embodiment, the support portion 102 is attached to the fixing holder 79. The support portion 102 is made of a flexible sheet-like elastic body. The temperature detector 101 of the temperature sensor 100 is in contact with an inner circumferential surface of the fixing belt 61 by the support portion 102, which presses the temperature detector 101, and this contact state is maintained by the support portion 102. In this manner, the temperature of the fixing belt 61 is measured. The support portion 102 may be made of a heat-resistant resin film, for example. In addition, two lead wires (not shown in the figure) connected to the temperature detector 101 are embedded in the support portion 102. The two lead wires are connected to each other via the temperature detector 101. The temperature of the fixing belt 61 is made to be measurable by causing an electric current to flow through the lead wires, and by monitoring the resistance of the temperature detector 101.

Here, in order to accurately measure the temperature of the fixing belt 61, it is necessary to maintain a state where the temperature detector 101 of the temperature sensor 100 and the inner circumferential surface of the fixing belt 61 are not easily separated from each other. In other words, it is necessary to maintain the state where the temperature detector 101 of the temperature sensor 100 and the inner circumferential surface of the fixing belt 61 are in contact with each other.

For this reason, the temperature sensor 100 shown in FIG. 13A is configured so that the support portion 102 presses the temperature detector 101 against the inner circumferential surface of the fixing belt 61 as described above. Meanwhile, in a case where the pressing roll 62 is separated from the fixing belt 61 by the aforementioned moving mechanism, and then, the fixing belt 61 deforms, as described in FIG. 11, the distance between the attachment portion of the temperature sensor 100 and the fixing belt 61 easily changes, so that the temperature detector 101 and the inner circumferential surface of the fixing belt 61 are easily separated. In other words, it becomes difficult to maintain the aforementioned contact state.

In the fixing unit 60*a* of the present exemplary embodiment, the state where the fixing belt 61, the temperature-sensitive magnetic member 64 and the induction member 66 are mutually in contact with each other is maintained by the elastic member 74 as described above, so that the temperature detector 101 of the temperature sensor 100 and the inner circumferential surface of the fixing belt 61 are not relatively easy to be separated from each other. However, in the present exemplary embodiment, in order to further make the temperature detector 101 and the inner circumferential surface of the fixing belt 61 difficult to be separated from each other, and to maintain the contact state therebetween, the position where the temperature sensor 100 is arranged is selected.

Firstly, the arrangement position of the temperature sensor 100 may be adjacent to the one edge of the temperature-sensitive magnetic member 64 at a side where the sheet P exits, which is the upstream side in the rotation direction of the fixing belt 61. This portion corresponds to a region near the one edge 77 of the magnetic path shielding member 73 in FIG. 11. Specifically, the fixing belt 61 is not relatively easy to deform at this region even when the pressing roll 62 is separated therefrom by the moving mechanism, so that the state where the temperature detector 101 of the temperature sensor 100 and the inner circumferential surface of the fixing belt 61 are in contact with each other is easily maintained.

Moreover, this edge 77 is secured in the manner described above. On the other hand, at a region near the elastic member 74, which is the region at the downstream side in the rotation direction of the fixing belt 61, that is, the sheet entering side, components located around the elastic member 74 move by action of the elastic member 74 in a vertical direction viewed in FIG. 11. For this reason, when the temperature sensor 100 is arranged near the elastic member 74, the temperature detector 101 and the inner circumferential surface of the fixing belt 61 are easily separated from each other due to the influence of the moving of the components, and it becomes harder to maintain the contact state therebetween. From this perspective as well, it is effective to arrange the temperature sensor 100 at the position adjacent to the one edge of the temperature-sensitive magnetic member 64 at the exit side of the sheet P, where the contact state therebetween is not easily influenced by the elastic member 74.

In other words, the temperature sensor 100 is to be arranged at a position where the contact state between the temperature detector 101 and the inner circumferential surface of the fixing belt 61 is easily maintained in every state where the fixing belt 61 is displaced in accordance with the moving of the pressing roll 62. It is the position where the amount of displacement of the fixing belt 61 is likely to become within a movable range of the support portion 102 of the temperature sensor 100. Moreover, it is the position where the contact state between the temperature detector 101 of the temperature sensor 100 and the fixing belt 61 is easily maintained by a pressing force within a range set in advance.

Figure 13B:
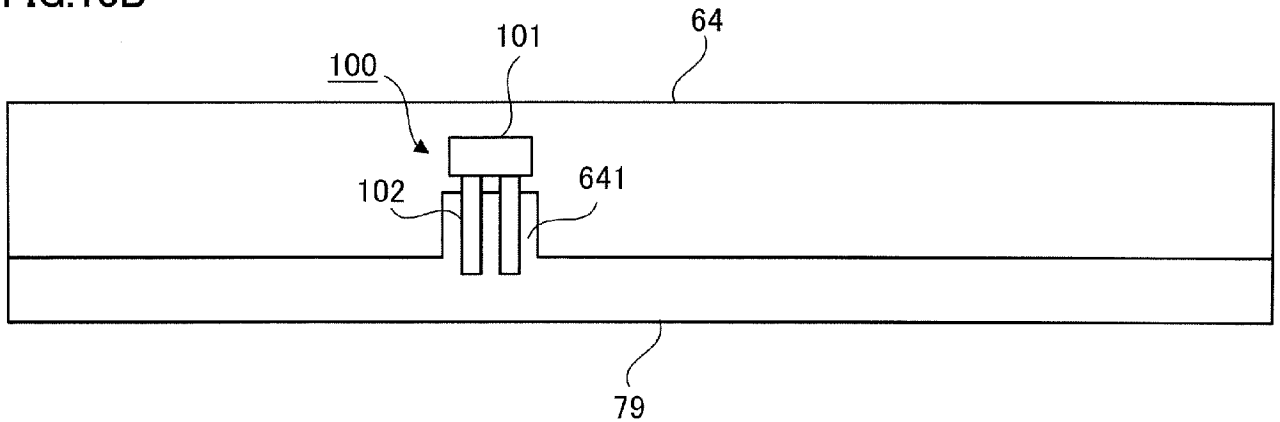
FIG. 13B is a diagram for explaining a state where the temperature sensor is viewed from an X2 direction in FIGS. 3 and 11.

FIG. 13B is a diagram for explaining a state where the temperature sensor 100 is viewed from an X2 direction in FIGS. 3 and 11. Note that, in FIG. 13B, the fixing belt 61 is not illustrated for facilitating the description of the state.

In FIG. 13B, the temperature sensor 100 is arranged so as to be located at the position of a cutout 641 formed on the temperature-sensitive magnetic member 64. In this manner, a larger degree of freedom occurs in the attachment position of the temperature sensor 100. Note that, although an example of the case where the cutout 641 is provided at the temperature-sensitive magnetic member 64 is shown herein, the attachment position of the temperature sensor 100 is not limited to this. For example, a hole may be formed in the temperature-sensitive magnetic member 64, and the temperature sensor 100 may be arranged at the position of the hole.

Note that, the fixing unit to which the present exemplary embodiment is applicable is not limited to the fixing unit 60*a* shown in FIGS. 3 and 11.

Figure 14:
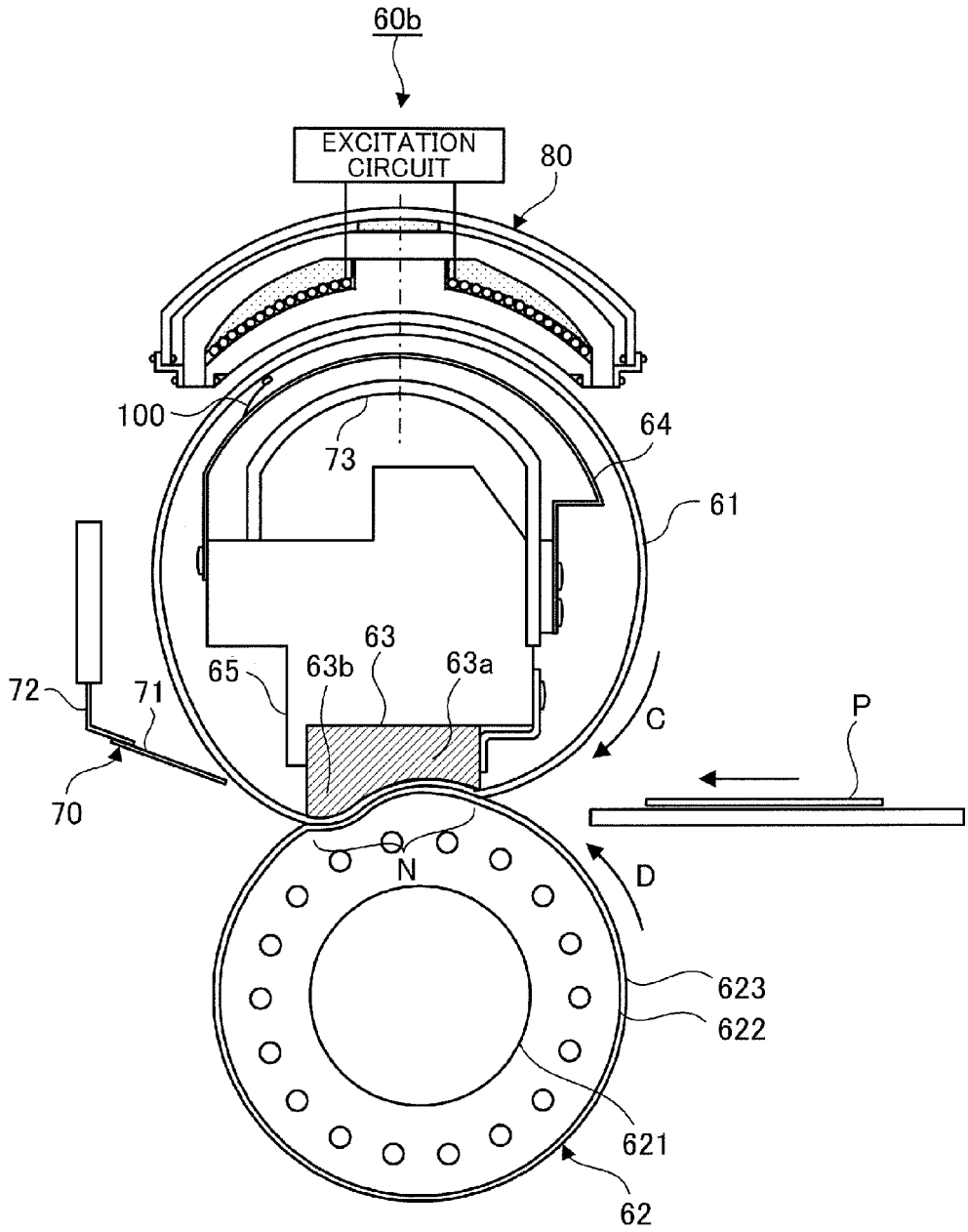
FIG. 14 is a diagram for explaining a second configuration of the fixing unit of the exemplary embodiment.

FIG. 14 is a diagram for explaining a second configuration of the fixing unit of the exemplary embodiment.

As compared with the fixing unit 60*a* shown in FIGS. 3 and 11, a fixing unit 60*b* shown in FIG. 14 does not include the induction member 66. Moreover, the fixing unit 60*b* is different from the fixing unit 60*a* in that the fixing belt 61 and the temperature-sensitive magnetic member 64 are not in contact with each other and are separated from each other. In addition, the fixing unit 60*b* does not include the mechanism to press the temperature-sensitive magnetic member 64 against the fixing belt 61 with the elastic member 74. Since the fixing unit 60*b* does not include the induction member 66, there is no such a case where the temperature-sensitive magnetic member 64 and the induction member 66 are mutually in contact with each other. Accordingly, in particular, the loss of heat, which occurs when the heat generated from the temperature-sensitive magnetic member 64 flows into the induction member 66 at the time of starting the fixing unit 60*b*, is suppressed. Thus, the fixing unit 60*b* has a feature that enables shortening of a period of time required for the fixing belt 61 to reach the fixation setting temperature (warm up time) as compared with the aforementioned fixing unit 60*a*.

The pressing roll 62 also includes the moving mechanism in this fixing unit 60*b*. Specifically, the pressing roll 62 performs operations to press the fixing belt 61 when fixation is performed and to separate from the fixing belt 61 during a period other than the time when the fixation is performed.

Figure 15A:
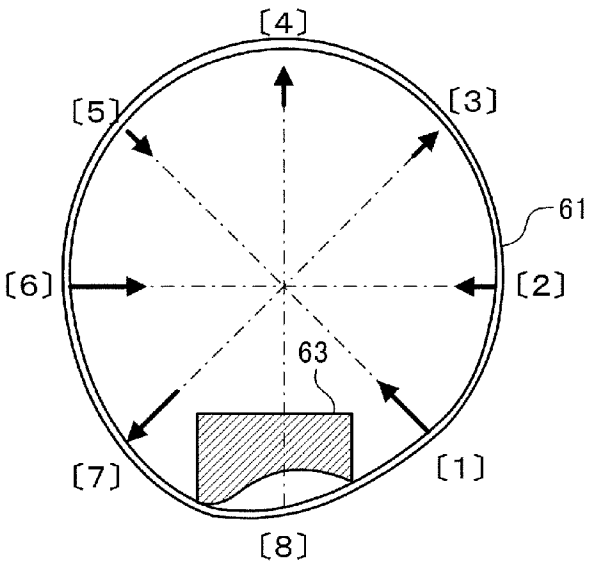
FIG. 15A is a diagram for explaining the amount of deformation by use of a perfect circle of the fixing belt as the reference, the fixing belt being in a state where the pressing roll is separated therefrom.
Figure 15B:
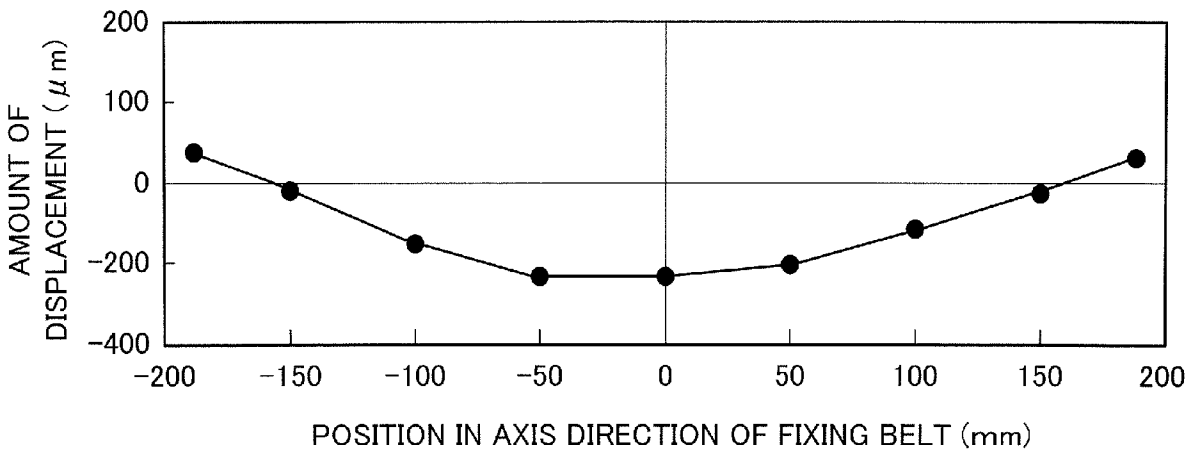
FIG. 15B is a graph for explaining the amount of deformation of the fixing belt when the pressing roll returns to the state of pressing the fixing belt from the state of separating therefrom.

FIGS. 15A and 15B are diagrams for explaining deformation of the fixing belt 61.

Here, FIG. 15A is a diagram for explaining the amount of deformation by use of a perfect circle of the fixing belt as the reference, the fixing belt being in a state where the pressing roll 62 is separated therefrom. FIG. 15B is a graph for explaining the amount of deformation of the fixing belt 61 when the pressing roll 62 returns to the state of pressing the fixing belt 61 from the state of separating therefrom.

In FIG. 15A, the fixing belt 61 is uniformly divided into eight portions in the circumferential direction thereof, and the eight portions are denoted by reference numerals [1] to [8], respectively. The amount of displacement at each of the portions [1] to [7] is indicated by an arrow. The direction of the arrow herein indicates the direction of deformation, and the length of the arrow indicates the scale of deformation, that is, the amount of deformation.

As seen from FIG. 15A, in the state where the fixing belt 61 is separated from the pressing roll 62, the fixing belt 61 is deformed so as to be compressed inwardly as compared to the perfect circle at the portions thereof denoted by reference numerals [1], [2], [5] and [6], respectively. The amount of deformation is small at each of the portions [2] and [5]. Here, the temperature detector 101 of the temperature sensor 100 is more difficult to be separated from the inner circumferential surface of the fixing belt 61, and the contact state therebetween is more easily maintained, in a case where the fixing belt 61 is deformed in a way to be concavely compressed as compared to the circular shape thereof. Specifically, in this case, since the temperature detector 101 of the temperature sensor 100 and the inner circumferential surface of the fixing belt 61 are closer to each other, they are not easily separated from each other, and the contact state therebetween is easily maintained.

In addition, in a state where the pressing roll 62 is caused to press the fixing belt 61, the temperature sensor 100 may be arranged at a position where the fixing belt 61 is displaced in a direction that the fixing belt 61 is concavely compressed. In this case, since the temperature detector 101 of the temperature sensor 100 and the inner circumferential surface of the fixing belt 61 are closer to each other, they are not easily separated, and the contact state therebetween is easily maintained. Although it is not shown in the figure, in the state where the pressing roll 62 is caused to press the fixing belt 61, the portions where the fixing belt 61 is displaced in a direction to be concavely compressed are two portions [4] and [5].

For the reasons described above, the temperature sensor 100 is to be attached to a position where the shape of the fixing belt 61 forms a concave shape in the rotation surface of the fixing belt 61 as compared to the circular shape before and after the movement of the pressing roll 62.

Specifically, the portion that satisfies this requirement is the portion [5]. Accordingly, the temperature sensor 100 is to be arranged at this portion [5] or a position adjacent to this portion in the rotation surface of the fixing belt 61. The position of the portion [5] herein is the position where the temperature sensor 100 is actually arranged in FIG. 14, and where the contact state between the temperature detector 101 and the inner circumferential surface of the fixing belt 61 is easily maintained in every state where the fixing belt 61 is displaced in accordance with the movement of the pressing roll 62. In other words, it is the position where the amount of displacement of the fixing belt 61 is likely to become within a movable range of the support portion 102 of the temperature sensor 100. In addition, it is the position adjacent to the one edge of the temperature-sensitive magnetic member 64 at the side where the sheet P exits. Moreover, it is the position allowing the fixing belt 61 and the temperature detector 101 of the temperature sensor 100 in contact with each other to be maintained by pressing force within a range set in advance.

FIG. 15B shows a case where the fixing belt 61 is divided into the eight portions in the rotational axis direction thereof, and then, the amount of displacement at the aforementioned portion [5] in the rotational axis direction is measured at nine points.

Here, the horizontal axis indicates the positions in the axis direction of the fixing belt 61 and distances from the center part of the fixing belt 61 are indicated with a unit of mm when the center part thereof is set as zero (0). The vertical axis indicates the amount of displacement in the rotational axis direction of the fixing belt 61 with a unit of μm. Note that, the amount of displacement greater than zero (0) indicates that the particular point is displaced outward, that is, the particular point is displaced in a convex direction, and the amount of displacement smaller than zero (0) indicates that the point is displaced inward, that is, the point is displaced in a concave direction.

As seen from FIG. 15B, the amount of displacement in the direction of the rotational axis of the fixing belt 61 is larger at the center part of the fixing belt 61 and smaller at the ends thereof. However, if the temperature sensor 100 is arranged at one of ends of the fixing belt 61, the small size sheet P does not pass through the ends of the fixing belt 61 when the small size sheet P is inserted into the fixing unit 60*b*. For this reason, when the temperature sensor 100 is arranged at one of the ends, a concern that the temperature sensor 100 does not monitor a decrease in the temperature of the fixing belt 61 arises. From this perspective, the temperature sensor 100 may be arranged at a position close to the center part of the fixing belt 61. As a conclusion, on the basis of the relationship of balance between these two factors, the temperature sensor 100 may be arranged at a position as close as possible to one of the ends of the fixing belt 61 at the vicinity of the center part thereof in the rotational axis direction of the fixing belt 61. In other words, the position where the temperature sensor 100 is arranged may be a position adjacent to the center part of the fixing belt 61 in the rotational axis direction of the fixing belt 61. To be more specific, the temperature sensor 100 may be arranged at a position distant from the center part of the fixing belt 61 by approximately ¼ to 1/20 of the width of the fixing belt 61. In the present exemplary embodiment, the temperature sensor 100 is arranged at a position distant from the center part of the fixing belt 61 by 1/10 of the width of the fixing belt 61. This indicates that the temperature sensor 100 is arranged at a position distant from the center part of the fixing belt 61 by 40 mm in a case where the fixing belt 61 has a width of 400 mm, for example.

<Description of Temperature Control of Fixing Belt>

Next, a description will be given of a temperature control of the fixing belt 61.

Figure 16:
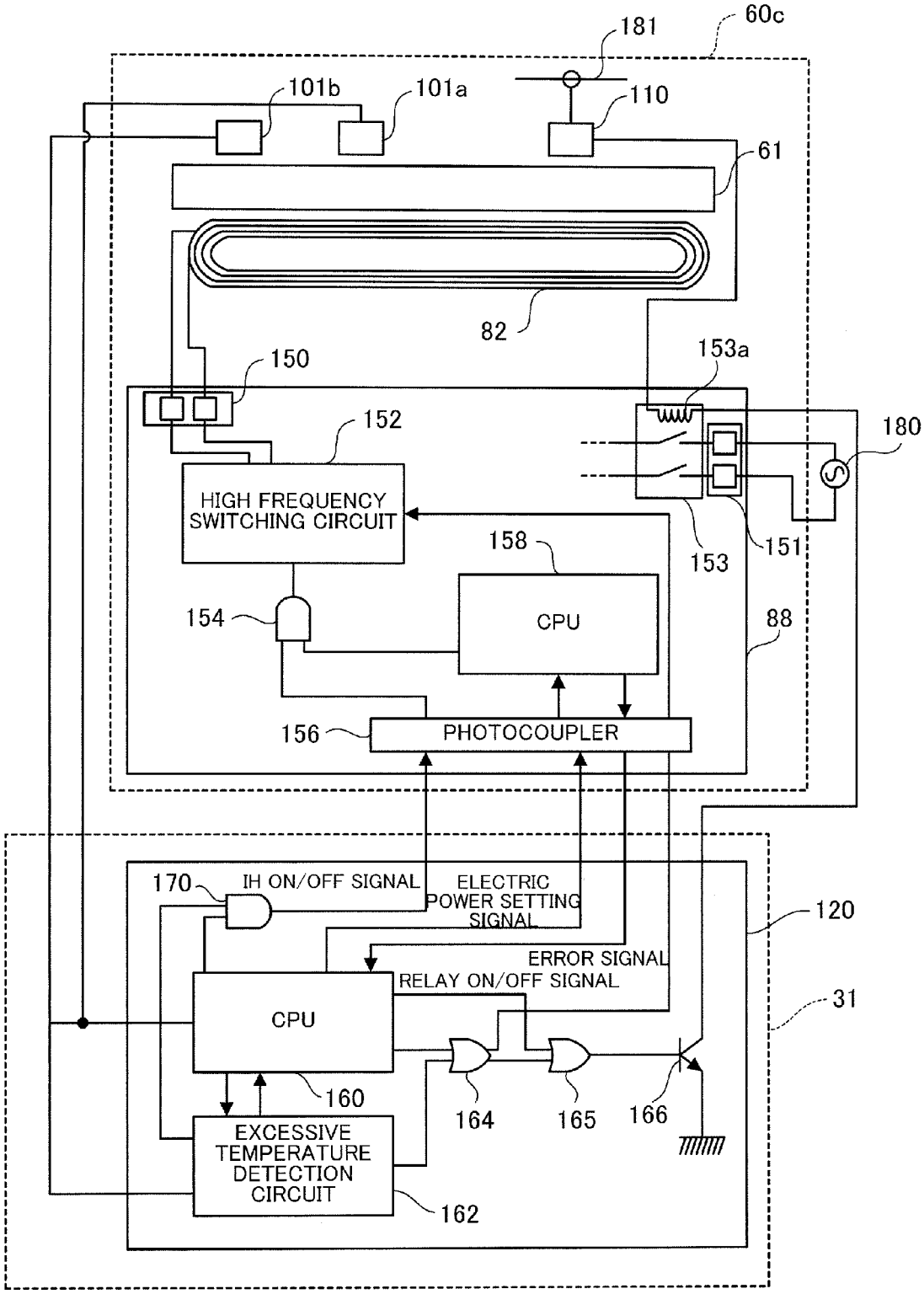
FIG. 16 is a block diagram showing an example of a circuit configuration that controls an electric power supplied to the IH heater.

FIG. 16 is a block diagram showing an example of a circuit configuration that controls an electric power supplied to the IH heater 80. As shown in FIG. 16, the control of power supply to the excitation circuit 88 is performed by an electromagnetic induction heating controller 120 provided in the controller 31, and the excitation circuit 88 provided in the IH heater 80 of a fixing unit 60*c*.

The electromagnetic induction heating controller 120 provided in the controller 31 includes: a CPU 160 that is a control circuit; an excessive temperature detection circuit 162 that detects a change in the temperature of the fixing belt 61; OR circuits 164 and 165 each of which is a logic device; and an AND circuit 170.

The excitation circuit 88 of the IH heater 80 includes: a CPU 158 that is a control circuit; a relay 153 that is used for inputting (connecting) or blocking an electric power from an external commercial power supply 180; and a photocoupler 156 that transmits and receives signals to and from the electromagnetic induction heating controller 120. The excitation circuit 88 of the IH heater 80 further includes: an AND circuit 154 that is a logic device; a high frequency switching circuit 152 that is a high frequency generating circuit; output ports 150 each of which outputs an electric power to the excitation coil 82; and input ports 151 each of which receives an electric power from the external commercial power supply 180.

To being with, the CPU 160 of the electromagnetic induction heating controller 120 includes a temperature control circuit that controls the temperature of the fixing belt 61. Specifically, the CPU 160 outputs various types of control signals on the basis of temperature detection signals from temperature detectors (thermistors) 101*a* and 101*b* each being as an example of a temperature detection member that detects the temperature of the fixing belt 61, the control signals controlling the temperature of the fixing belt 61.

Specifically, in accordance with presence or absence of an error signal from the excitation circuit 88, and the surface temperature of the fixing belt 61 or the like, the CPU 160 outputs, to the AND circuit 170, a permission signal that permits supply of a high frequency electric current to the excitation coil 82 from the high frequency switching circuit 152 provided on the excitation circuit 88. On the basis of a control signal from the excessive temperature detection circuit 162 and the permission signal from the CPU 160, the AND circuit 170 outputs a signal (IH ON/OFF signal) that controls ON/OFF of the IH heater 80 to the excitation circuit 88.

The CPU 160 also outputs an electric power setting signal to the excitation circuit 88 on the basis of temperature detection signals from the temperature detectors 101*a* and 101*b* (primarily from the temperature detector 101*a*). The CPU 160 also outputs an abnormal signal indicating an abnormal state to the OR circuit 164 in a case where the surface temperature of the fixing belt 61 increases and exceeds the defined value with reference to the current operation state of the fixing unit 60*c*.

The CPU 160 also outputs, to the OR circuit 165, a signal (relay ON/OFF signal) that controls ON/OFF of the relay 153 provided in the excitation circuit 88.

The excessive temperature detection circuit 162 of the electromagnetic induction heating controller 120 detects a change in the surface temperature of the fixing belt 61 from the surface temperature of the fixing belt 61 detected by the temperature detector 101*b* arranged at a position at an end side of the fixing belt 61. When the amount of the change in the surface temperature of the fixing belt 61 is within a range set in advance, the excessive temperature detection circuit 162 outputs a normal signal to the CPU 160, the AND circuit 170 and the OR circuit 164, the normal signal indicating that the surface temperature of the fixing belt 61 is in a normal state. On the other hand, when the amount of the change in the surface temperature of the fixing belt 61 exceeds the range set in advance, the excessive temperature detection circuit 162 outputs an abnormal signal to the CPU 160, the AND circuit 170 and the OR circuit 164, the abnormal signal indicating that the surface temperature of the fixing belt 61 is in an abnormal state.

Next, the AND circuit 170 is configured so as to output the IH ON/OFF signal to the excitation circuit 88 in a case where the permission signal from the CPU 160 and the normal signal from the excessive temperature detection circuit 162 are supplied thereto.

In addition, the OR circuit 164 generates a drive signal on the basis of the abnormal signal from the CPU 160 and the abnormal signal from the excessive temperature detection circuit 162, the drive signal driving the relay 153 of the excitation circuit 88. The OR circuit 164 causes the relay 153 to open and close by controlling a semiconductor switch device 166 provided in the electromagnetic induction heating controller 120. A DC power supply line 181 (5V, for example) and a thermo switch 110 configured of a thermostat, a temperature fuse and the like are connected to the relay 153. Specifically, the OR circuit 164 outputs, via the OR circuit 165, a signal that blocks the semiconductor switch device 166 when receiving at least any one of the abnormal signal from the CPU 160 and the abnormal signal from the excessive temperature detection circuit 162. In this case, the electric current that flows from the DC power source line 181 to the excitation coil 153*a* arranged on the relay 153 is blocked, and the relay 153 is blocked. Thereby, the power supply from the external commercial power supply 180 to the excitation circuit 88 stops. At this time, simultaneously, the CPU 160 of the electromagnetic induction heating controller 120 directly causes the supply of a high frequency electric current to the excitation coil 82 to stop by controlling the high frequency switching circuit 152 of the excitation circuit 88 without involving the CPU 158.

In a case where the temperature of the fixing belt 61 increases to an abnormal high temperature, and then, the thermo switch 110 as an example of a blocking member is disconnected, the electric current that flows from the DC power supply line 181 through the excitation coil 153*a* arranged on the relay 153 is blocked, and the relay 153 is blocked as well.

The photocoupler 156 provided on the excitation circuit 88 transmits and receives signals from and to the electromagnetic induction heating controller 120. Specifically, a power setting signal is supplied to the photocoupler 156 from the CPU 160 of the electromagnetic induction heating controller 120 via a signal line. Moreover, the IH ON/OFF signal is supplied to the photocoupler 156 from the AND circuit 170 connected to the CPU 160. Meanwhile, the photocoupler 156 outputs an error signal from the CPU 158 of the excitation circuit 88 to the CPU 160 of the electromagnetic induction heating controller 120 via a signal line.

The photocoupler 156 then outputs the supplied power setting signal to the CPU 158 of the excitation circuit 88. The photocoupler 156 also outputs the supplied IH ON/OFF signal to the CPU 158 and the AND circuit 154.

The CPU 158 provided on the excitation circuit 88 controls driving of the high frequency switching circuit 152.

Specifically, the CPU 158 drives and controls the high frequency switching circuit 152 on the basis of the power setting signal supplied from the CPU 160 of the electromagnetic induction heating controller 120. The CPU 158 determines various errors occurring in the IH heater 80, then generates an error signal, and outputs the error signal to the CPU 160 of the electromagnetic induction heating controller 120.

In a case where no error or the like occurs in the IH heater 80, the CPU 158 outputs an IH ON/OFF signal to the AND circuit 154 on the basis of the IH ON/OFF signal supplied from the photocoupler 156. In a case where the IH ON/OFF signal from the CPU 158 of the excitation circuit 88 and the IH ON/OFF signal from the photocoupler 156 are supplied at the same time, the AND circuit 154 outputs the IH ON/OFF signal to the high frequency switching circuit 152.

The high frequency switching circuit 152 provided on the excitation circuit 88 applies an electric power set by the CPU 158 to the excitation coil 82 via the output ports 150, in a case where the IH ON/OFF signal from the AND circuit 154 is supplied thereto.

Meanwhile, the input ports 151 to which an electric power is inputted from the external commercial power supply 180 are supplied with an AC voltage via the relay 153 and a noise filter (not shown in the figure). The AC voltage to be supplied via the input ports 151 is supplied to each component of the excitation circuit 88.

Note that, any one of the input ports 151 is provided with a fuse (not shown in the figure) and blocks supply of an electric power at the time of an abnormal state. In addition, a rectification circuit and a constant-voltage circuit are provided on the excitation circuit 88 although these components are not shown in the figure. The rectification circuit rectifies the voltage of the external commercial power supply 180. The constant-voltage circuit adjusts the output voltage of this rectification circuit to be at a constant level suitable for the operation of the CPU 158 and then outputs the adjusted output voltage.

<Description of Arrangement Configuration of Temperature Detectors (Thermistors)>

Next, a description will be given of an arrangement configuration of the temperature detectors 101*a* and 101*b* used for controlling the temperature of the fixing belt 61.

Figure 17:
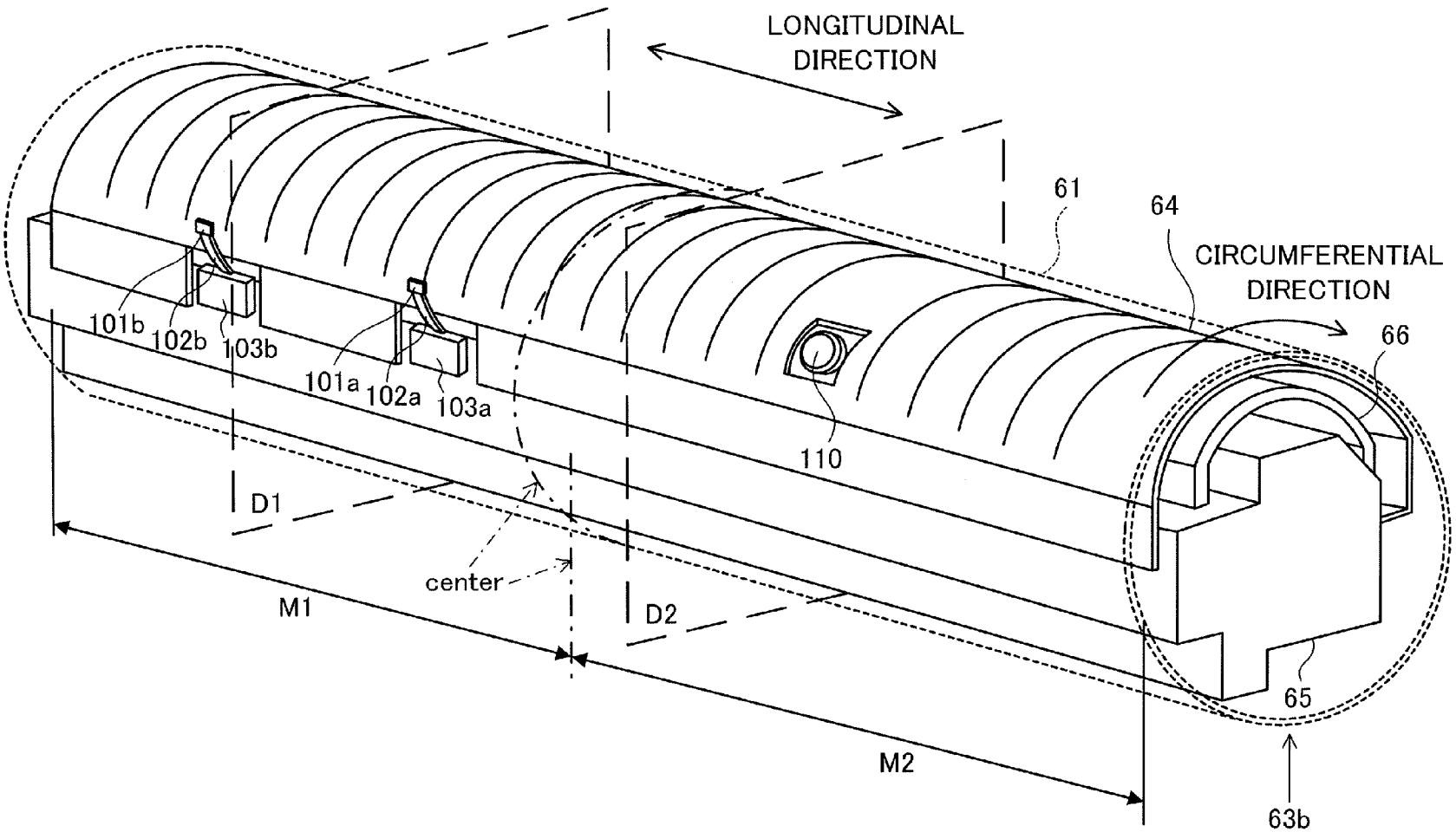
FIG. 17 is a perspective view showing a configuration of an inner side of the fixing belt.

FIG. 17 is a perspective view showing a configuration of an inner side of the fixing belt 61. As shown in FIG. 17, both of the temperature detectors 101*a* and 101*b* are arranged in a region (M1) extending to the one end of the fixing belt 61 in the longitudinal direction thereof from the center thereof. The thermo switch 110 is arranged in a region (M2) which is located at the opposite side of an arrangement region of the temperature detectors 101*a* and 101*b*, with respect to the center of the fixing belt 61 in the longitudinal direction thereof.

As described above, the fixing belt 61 rotationally moves in the circumferential direction thereof while maintaining the cross sectional shape at the both ends in a circular shape by the end caps 67 (refer to FIG. 5) provided at the both ends of the fixing belt 61, respectively. Meanwhile, at a region of the fixing belt 61 other than the both ends thereof, the cross sectional shape at the region is maintained to be the circular shape set by the end caps 67, by the rigidity of the fixing belt 61 itself. However, the fixing belt 61 passes through the peeling nip region 63*b* where a locally large nip pressure is formed. Since the locally large nip pressure is formed at the peeling nip region 63*b*, the region of the fixing belt 61 other than the both ends thereof is deformed so as to have a smaller curvature radius of the surface of the fixing belt 61. For this reason, the fixing belt 61 receives tensile force toward the peeling nip region 63*b* at a downstream region following the peeling nip region 63*b* where the fixing belt 61 passes through. Accordingly, tensile force toward the temperature-sensitive magnetic member 64 is applied to the fixing belt 61.

For this reason, in the present exemplary embodiment, the temperature detectors 101*a* and 101*b* each detecting the temperature of the fixing belt 61 are arranged at the downstream region following the peeling nip region 63*b* where the fixing belt 61 passes through, which is an upstream of a region where the fixing belt 61 is heated again, in the circumferential direction of the fixing belt 61. At this region, the tensile force toward the temperature-sensitive magnetic member 64 is applied to the fixing belt 61. The temperature detectors 101*a* and 101*b* are arranged so as to press the fixing belt 61 outwardly (toward the opposite side of the temperature-sensitive magnetic member 64) from the inner circumferential surface of the fixing belt 61. Thereby, the temperature detectors 101*a* and 101*b* are set so as to increase the adhesiveness with the fixing belt 61 by the tensile force toward the temperature-sensitive magnetic member 64, which is applied to the fixing belt 61, and the pressing force to press the fixing belt 61 from the temperature-sensitive magnetic member 64 side, which is applied to the temperature detectors 101*a* and 101*b*. When the adhesiveness between the fixing belt 61 and the temperature detectors 101*a* and 101*b* increases, accuracy in the detection of temperature of the fixing belt 61 by the temperature detectors 101*a* and 101*b* improves.

Specifically, the temperature detectors 101*a* and 101*b* are secured onto the frame 65 by support units 103*a* and 103*b*, respectively, and are pressed by support portions (biasing portions) 102*a* and 102*b* against the inner circumferential side of the fixing belt 61, respectively.

Figure 18:
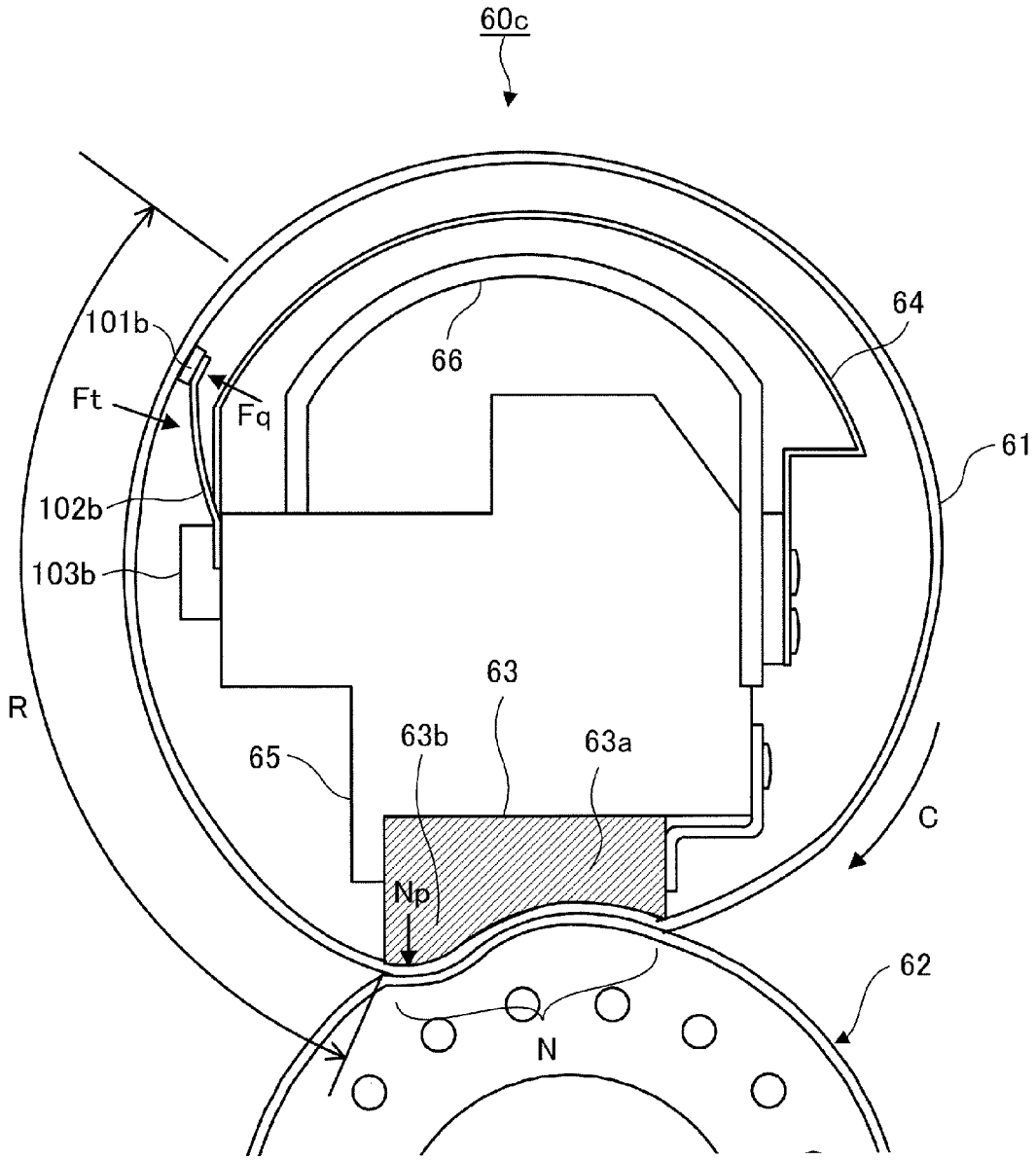
FIG. 18 is a cross sectional configuration diagram of an inner side of the fixing belt at the position where the thermistor is arranged.

FIG. 18 is a cross sectional configuration diagram (plain surface D1 of FIG. 17) of an inner side of the fixing belt 61 at the position where the temperature detector 101*b* is arranged. As shown in FIG. 18, a locally large nip pressure Np is set at the peeling nip region 63*b*. For this reason, tensile force Ft toward the temperature-sensitive magnetic member 64 is applied to the fixing belt 61 at a region R, which is the downstream region following the peeling nip region 63*b* where the fixing belt 61 passes through, and which is the upstream of a region where the fixing belt 61 is heated again. Meanwhile, the temperature detector 101*b* is secured onto the frame 65 by the support unit 103*b* while being supplied with pressing force Fq toward the inner circumferential surface of the fixing belt 61 by the support portion 102*b*. Thereby, the adhesiveness between the fixing belt 61 and the temperature detector 101*b* increases, and accuracy of the temperature of the fixing belt 61, which is detected by the temperature detector 101*b*, improves. The same is true for the other one of the temperature detectors, which is the temperature detector 101*a*.

<Description of Arrangement Configuration of Thermo Switch>

Next, a description will be given of an arrangement configuration of the thermo switch 110.

Figure 19:
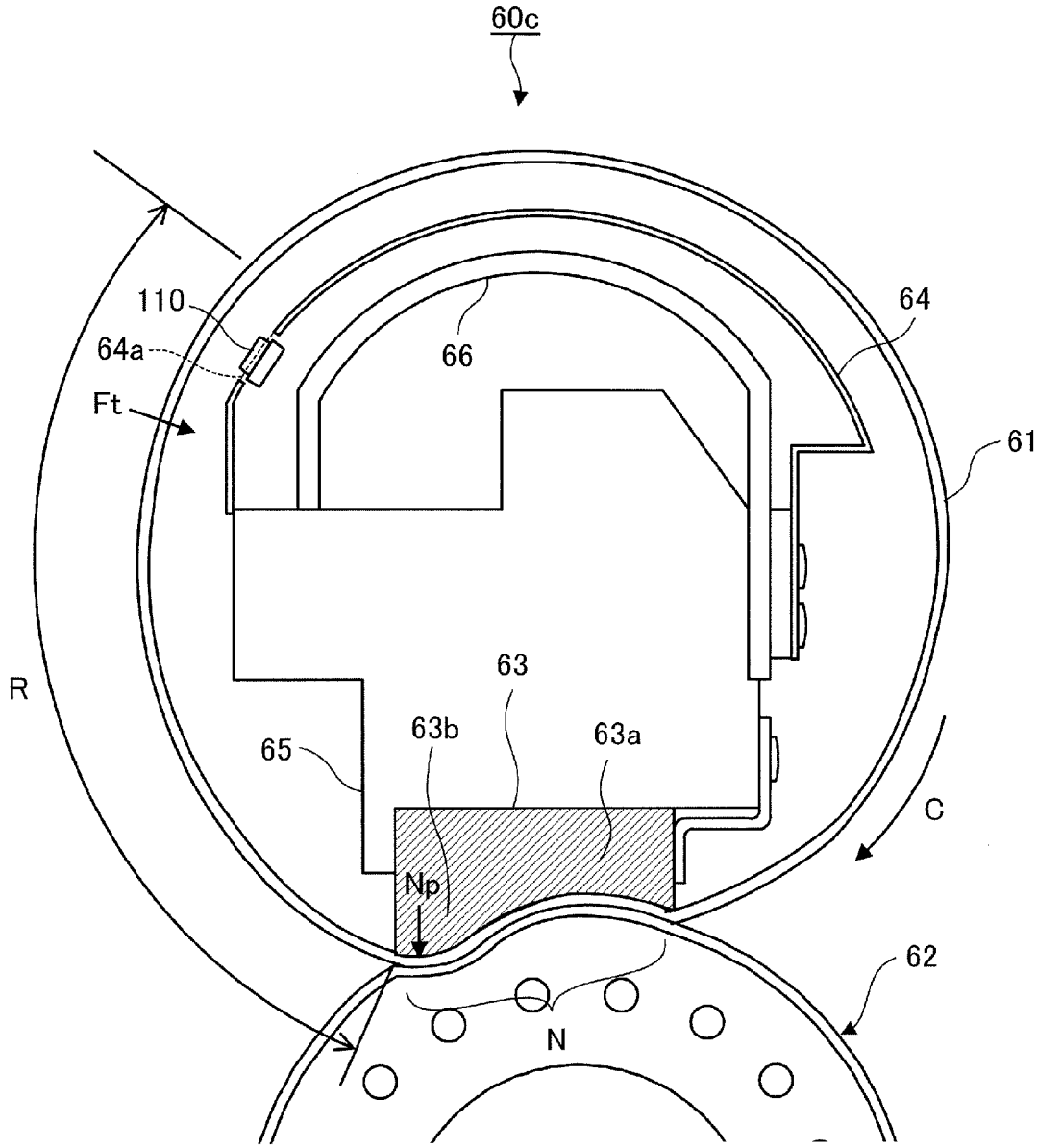
FIG. 19 is a cross sectional configuration diagram of an inner side of the fixing belt at a position where the thermo switch is arranged.

FIG. 19 is a cross sectional configuration diagram (plain surface D2 of FIG. 17) of an inner side of the fixing belt 61 at a position where the thermo switch 110 is arranged. As shown in FIG. 17, the thermo switch 110 is arranged at a region (region M2 in FIG. 17), which is located at the opposite side of the arrangement region (region M1 in FIG. 17) of the temperature detectors 101*a* and 101*b*, with respect to the center of the fixing belt 61 in the longitudinal direction thereof. As shown in FIG. 19, as in the case of the temperature detectors 101*a* and 101*b*, the thermo switch 110 is arranged in the region R, which is the downstream region following the peeling nip region 63*b* where the fixing belt 61 passes through, and which is the upstream of the region where the fixing belt 61 is heated again, in the circumferential direction of the fixing belt 61. In addition, the thermo switch 110 is set in a way that the entire surface or a part of the surface of the thermo switch 110 is positioned so as to be closer to the fixing belt 61 as compared to a surface position 64*a* of the temperature-sensitive magnetic member 64.

As described above, the tensile force Ft toward the temperature-sensitive magnetic member 64 is applied to the fixing belt 61 at the region R, which is the downstream region following the peeling nip region 63*b* where the fixing belt 61 passes through, and which is the upstream of the region where the fixing belt 61 is heated again. For this reason, the temperature-sensitive magnetic member 64 located at the region R is the component to which the fixing belt 61 passes through a position most closely among the components arranged at the inner side of the fixing belt 61, except the nip portion N. Accordingly, in a case where the temperature of the fixing belt 61 increases to an abnormally high temperature that causes the thermo switch 110 to be disconnected, and the fixing belt 61 shrinks, the fixing belt 61 is brought into contact with the temperature-sensitive magnetic member 64 located at the region R at an early stage. In particular, the region where the temperature-sensitive magnetic member 64 is arranged is the region where the fixing belt 61 is heated, so that, as compared with other regions, a large temperature increase occurs at this region. Accordingly, when the fixing belt 61 shrinks, there is a high possibility that the fixing belt 61 is initially brought into contact with the temperature-sensitive magnetic member 64 located at the region R.

In this respect, in the present exemplary embodiment, the thermo switch 110, which is disconnected when the temperature of the fixing belt 61 increases to an abnormally high temperature, is arranged at the region, which is the downstream region following the peeling nip region 63*b* where the fixing belt 61 passes through, and which is the upstream of the region where the fixing belt 61 is heated again, in the circumferential direction of the fixing belt 61. Moreover, at this time, the surface of the thermo switch 110 is set so as to further protrude toward the fixing belt 61 than the surface position 64*a* of the temperature-sensitive magnetic member 64 in order that the thermo switch 110 may be surely brought into contact with the shrunk fixing belt 61.

<Description of Relationship Between Temperature Detectors (Thermistors) and Thermo Switch in Arrangement Positions Thereof in Longitudinal Direction>

As shown in FIG. 17, the thermo switch 110 is arranged at the region (region M2), which is located at the opposite side of the arrangement region (region M1) of the temperature detectors 101*a* and 101*b*, with respect to the center of the fixing belt 61 in the longitudinal direction thereof.

As described above, in the case where the temperature of the fixing belt 61 increases to an abnormally high temperature that causes the thermo switch 110 to be disconnected, and the fixing belt 61 shrinks, the fixing belt 61 is brought into contact with the temperature-sensitive magnetic member 64 located at the region R at an early stage, in the circumferential direction of the fixing belt 61. In this case, at the region M1 where the temperature detectors 101*a* and 101*b* are arranged, the temperature detectors 101*a* and 101*b* are arranged so as to press the fixing belt 61 outwardly (toward the opposite side of the temperature-sensitive magnetic member 64) from the inner circumferential surface of the fixing belt 61. Accordingly, if the thermo switch 110 is arranged at the same side of the region as that of the arrangement region M1 of the temperature detectors 101*a* and 101*b* in the longitudinal direction of the fixing belt 61, the temperature detectors 101*a* and 101*b* are interposed between the shrunk fixing belt 61 and the temperature-sensitive magnetic member 64 in the region R in the circumferential direction of the fixing belt 61. For this reason, even if the surface of the thermo switch 110 is set so as to further protrude toward the fixing belt 61 than the surface position 64*a* of the temperature-sensitive magnetic member 64, there is a possibility that the fixing belt 61 is not brought into contact with the surface of the thermo switch 110 since the temperature detectors 101*a* and 101*b* are interposed therebetween. In particular, in a configuration in which two temperature detectors are arranged, one of which primarily detects the surface temperature of the fixing belt 61 such as the temperature detector 101*a*, and the other one of which primarily detects an abnormal state of the surface temperature of the fixing belt 61 such as the temperature detector 101*b*, the gap between the shrunk fixing belt 61 and the temperature-sensitive magnetic member 64 is likely to be formed over a broad region in the longitudinal direction of the fixing belt 61, the broad region including the positions where the temperature detectors 101*a* and 101*b* are arranged. For this reason, at the region M1 extending from the center of the fixing belt 61, where the temperature detectors 101*a* and 101*b* are arranged, there is a possibility that the shrunk fixing belt 61 and the thermo switch 110 are not brought into contact with each other, and the responsiveness of the thermo switch 110 decreases.

In this respect, in the present exemplary embodiment, the thermo switch 110 is arranged at the region M2, which is at the opposite side of the arrangement region M1 of the temperature detectors 101*a* and 101*b*, with respect to the center of the fixing belt 61 in the longitudinal direction of the fixing belt 61. Thereby, in a case where the temperature of the fixing belt 61 increases to an abnormally high temperature that causes the thermo switch 110 to be disconnected, and the fixing belt 61 shrinks, the gap formed between the shrunk fixing belt 61 and the temperature-sensitive magnetic member 64 because of the temperature detectors 101*a* and 101*b* interposed therebetween is not likely to extend to the position where the thermo switch 110 is arranged. In addition, even if the gap formed between the fixing belt 61 and the temperature-sensitive magnetic member 64 because of the temperature detectors 101*a* and 101*b* interposed therebetween influences the position where the thermo switch 110 is arranged, the amount of the gap is subtle. Thus, when the thermo switch 110 is arranged at the region M2, the certainty and immediacy for the shrunk fixing belt 61 and the thermo switch 110 to be brought into contact with each other when the fixing belt 61 shrinks, and the responsiveness of the thermo switch 110 improves. Thereby, in a case where the temperature of the fixing belt 61 increases to an abnormally high temperature, the thermo switch 110 is immediately disconnected, and the flow of the electric current, as shown in FIG. 16, from the DC power source line 181 to the electromagnetic coil 153*a* arranged on the relay 153 stops. Then, the relay 153 is blocked with a high responsiveness.

As described above, when the thermo switch 110 is arranged in the region M2, even in a case where the fixing belt 61 shrinks, the certainty and immediacy for the shrunk fixing belt 61 and the temperature-sensitive magnetic member 64 to be brought into contact with each other is increased. Accordingly, the responsiveness of the thermo switch 110 improves. Thereby, in a case where the temperature of the fixing belt 61 increases to the abnormally high temperature, the thermo switch 110 is immediately disconnected. By this configuration, the certainty for the safety mechanism to activate in response to the abnormal increase in the temperature of the fixing belt 61 is more enhanced.

As described above, in the fixing unit 60*c* included in the image forming apparatus 1 of the present exemplary embodiment, the temperature-sensitive magnetic member 64 is arranged near the inner circumferential surface of the fixing belt 61. Thereby, an excessive increase in the temperature of the non-sheet passing region is suppressed.

Moreover, in the longitudinal direction of the fixing belt, both of the temperature detectors 101*a* and 101*b* are arranged in the region M1 extending to one edge from the center of the fixing belt 61, and the thermo switch 110 is arranged in the region M2, which is located at the opposite side of the region M1 where the temperature detectors 101*a* and 101*b* are arranged, with respect to the center of the fixing belt 61. Accordingly, an abnormal increase in the temperature of the fixing belt 61 is promptly detected.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device, comprising:

a fixing member that includes a conductive layer capable of self-heating by electromagnetic induction;

a drive unit that rotationally drives the fixing member;

a magnetic field generating member that generates an alternate-current magnetic field intersecting with the conductive layer of the fixing member;

a fixation pressing member that is movable so as to come into pressure contact with an outer circumferential surface of the fixing member and to separate from the outer circumferential surface;

a temperature measurement unit that includes a temperature detector and a support portion, that measures temperature of the fixing member with the temperature detector which is pressed by the support portion to be brought into contact with an inner circumferential surface of the fixing member, and that holds a contact state between the temperature detector and the inner circumferential surface of the fixing member in every state where the fixing member is displaced in accordance with movement of the fixation pressing member; and a magnetic path forming member that forms a magnetic path of the alternate-current magnetic field generated by the magnetic field generating member, and that conducts heat to the fixing member by self-heating by electromagnetic induction, wherein the temperature measurement unit is arranged at a position adjacent to an upstream edge of the magnetic path forming member at a side where a recording medium exits, and wherein the temperature measurement unit is arranged at any one of a position of a cutout and a position of a hole, any one of the cutout and the hole being formed at the upstream edge of the magnetic path forming member.

2. The fixing device according to claim 1, wherein the temperature measurement unit is arranged at such a position that an amount of the displacement of the fixing member is within a movable range of the support portion of the temperature measurement unit.

3. The fixing device according to claim 1, further comprising;

an elastic member that is arranged at any one of a position at a downstream edge of the magnetic path forming member and a position adjacent to the downstream edge, and that presses the magnetic path forming member toward the fixing member, wherein the upstream edge of the magnetic path forming member at the side where the recording medium exits is secured.

4. The fixing device according to claim 1, wherein the temperature measurement unit is arranged at a position adjacent to a center part of the fixing member in a direction of a rotational axis of the fixing member.

5. The fixing device according to claim 1, wherein the temperature measurement unit is arranged at a position where a shape of the fixing member at a rotation surface of the fixing member is concavely compressed as compared to a circular shape before and after the movement of the fixation pressing member.

6. The fixing device according to claim 1, wherein the magnetic path forming member is arranged to face the magnetic field generating member through the fixing member, forms a magnetic path of the alternate-current magnetic field generated by the magnetic field generating member within a temperature range not greater than permeability change start temperature at which permeability starts to decrease, and allows the alternate-current magnetic field generated by the magnetic field generating member to go through the magnetic path forming member within a temperature range exceeding the permeability change start temperature.

7. The fixing device according to claim 6, further comprising a blocking member that is arranged at a region opposite to a region where the temperature detector is arranged, with respect to a center position in a longitudinal direction of the magnetic path forming member, and that detects, from an inner side of the fixing member, that the temperature of the fixing member exceeds temperature set in advance, and then blocks an electric power supplied to the magnetic field generating member.

8. The fixing device according to claim 7, further comprising:

a pressing member that is arranged at the inner side of the fixing member, and that forms a nip portion between the fixing member and the fixation pressing member, by pressing the fixing member against the fixation pressing member arranged to be in contact with the fixing member, the recording medium passing through the nip portion, wherein, the temperature detector and the blocking member are arranged at any one of:

a region which is downstream of an arrangement position of the pressing member, and upstream of an arrangement position of the magnetic path forming member, in a moving direction of the fixing member, and a region where the magnetic path forming member is arranged.

9. The fixing device according to claim 7, wherein the temperature detector is arranged to press the inner circumferential surface of the fixing member.

10. The fixing device according to claim 7, wherein the magnetic path forming member is arranged not to be in contact with the fixing member.

11. The fixing device according to claim 1, further comprising a blocking member that is arranged at a region opposite to a region where the temperature detector is arranged, with respect to a center position in a longitudinal direction of the magnetic path forming member, and that detects, from an inner side of the fixing member, that the temperature of the fixing member exceeds the predetermined temperature, and then blocks an electric power supplied to the magnetic field generating member.

12. A fixing device, comprising:

a fixing member that includes a conductive layer capable of self-heating by electromagnetic induction;

a drive unit that rotationally drives the fixing member;

a magnetic field generating member that generates an alternate-current magnetic field intersecting with the conductive layer of the fixing member;

a fixation pressing member that is movable so as to come into pressure contact with an outer circumferential surface of the fixing member and to separate from the outer circumferential surface; and a temperature measurement unit that includes a temperature detector and a support portion, that measures temperature of the fixing member with the temperature detector which is pressed by the support portion to be brought into contact with an inner circumferential surface of the fixing member, and that holds a contact state between the temperature detector and the inner circumferential surface of the fixing member in every state where the fixing member is displaced in accordance with movement of the fixation pressing member;

a magnetic path forming member that forms a magnetic path of the alternate-current magnetic field generated by the magnetic field generating member, and that conducts heat to the fixing member by self-heating by electromagnetic induction, the temperature measurement unit being arranged at a position adjacent to an upstream edge of the magnetic path forming member at a side where a recording medium exits, wherein the magnetic path forming member is arranged to face the magnetic field generating member through the fixing member, forms a magnetic path of the alternate-current magnetic field generated by the magnetic field generating member within a temperature range not greater than permeability change start temperature at which permeability starts to decrease, and allows the alternate-current magnetic field generated by the magnetic field generating member to go through the magnetic path forming member within a temperature range exceeding the permeability change start temperature;

further comprising a blocking member that is arranged at a region opposite to a region where the temperature detector is arranged, with respect to a center position in a longitudinal direction of the magnetic path forming member, and that detects, from an inner side of the fixing member, that the temperature of the fixing member exceeds temperature set in advance, and then blocks an electric power supplied to the magnetic field generating member, wherein the blocking member is arranged such that a region of the blocking member which faces the inner circumferential surface of the fixing member is partially or entirely closer to the fixing member as compared to a surface of the magnetic path forming member, the surface facing the inner circumferential surface of the fixing member.

13. An image forming apparatus,. comprising:

a toner image forming unit that forms a toner image;

a transfer unit that transfers the toner image formed by the toner image forming unit to a recording medium; and a fixing unit that includes:

a fixing member that includes a conductive layer capable of self-heating by electromagnetic induction;

a drive unit that rotationally drives the fixing member;

a magnetic field generating member that generates an alternate-current magnetic field intersecting with the conductive layer of the fixing member;

a fixation pressing member that is movable to come into pressure contact with an outer circumferential surface of the fixing member and to separate from the outer circumferential surface; and a temperature measurement unit that includes a temperature detector and a support portion, that measures temperature of the fixing member with the temperature detector which is pressed by the support portion to be brought into contact with an inner circumferential surface of the fixing member, and that holds, with pressing force within a range set in advance, a contact state between the temperature detector and the inner circumferential surface of the fixing member in every state where the fixing member is displaced in accordance with movement of the fixation pressing member, wherein the fixing unit further comprises:

a magnetic path forming member that is arranged to face the magnetic field generating member through the fixing member, that forms a magnetic path of the alternate-current magnetic field generated by the magnetic field generating member within a temperature range not greater than permeability change start temperature at which permeability starts to decrease, and that allows the alternate-current magnetic field generated by the magnetic field generating member to go through the magnetic path forming member within a temperature range exceeding the permeability change start temperature; and a blocking member that is arranged at a region opposite to a region where the temperature detector is arranged, with respect to a center position in a longitudinal direction of the magnetic path forming member, and that detects, from an inner side of the fixing member, that the temperature of the fixing member exceeds temperature set in advance, and then that blocks an electric power supplied to the magnetic field generating member, wherein the temperature detector is arranged at a region toward one edge of the magnetic path forming member from a center of the magnetic path forming member in the longitudinal direction and detects the temperature of the fixing member from the inner side of the fixing member, and wherein the blocking member of the fixing unit is arranged such that a region of the blocking member which faces the inner circumferential surface of the fixing member is partially or entirely closer to the fixing member as compared to a surface of the magnetic path forming member, the surface facing the inner circumferential surface of the fixing member.

14. The image forming apparatus according to claim 13, wherein the fixing unit further comprises:

a magnetic path forming member that is arranged to face the magnetic field generating member through the fixing member, that forms a magnetic path of the alternate-current magnetic field generated by the magnetic field generating member within a temperature range not greater than permeability change start temperature at which permeability starts to decrease, and that allows the alternate-current magnetic field generated by the magnetic field generating member to go through the magnetic path forming member within a temperature range exceeding the permeability change start temperature; and a blocking member that is arranged at a region opposite to a region where the temperature detector is arranged, with respect to a center position in a longitudinal direction of the magnetic path forming member, and that detects, from an inner side of the fixing member, that the temperature of the fixing member exceeds temperature set in advance, and then that blocks an electric power supplied to the magnetic field generating member, wherein the temperature detector is arranged at a region toward one edge of the magnetic path forming member from a center of the magnetic path forming member in the longitudinal direction and detects the temperature of the fixing member from the inner side of the fixing member.

15. The image forming apparatus according to claim 14, wherein:

the fixing unit further comprises a pressing member that is arranged at the inner side of the fixing member, and that forms a nip portion between the fixing member and the fixation pressing member, by pressing the fixing member against the fixation pressing member arranged to be in contact with the fixing member, the recording medium passing through the nip portion; and the temperature detector and the blocking member of the fixing unit are arranged at any one of:

a region which is downstream of an arrangement position of the pressing member, and upstream of an arrangement position of the magnetic path forming member, in a moving direction of the fixing member, and a region where the magnetic path forming member is arranged.

16. The image forming apparatus according to claim 14, wherein the temperature detector of the fixing unit is arranged to press the inner circumferential surface of the fixing member.

17. The image forming apparatus according to claim 14, wherein the magnetic path forming member of the fixing unit is arranged not to be in contact with the fixing member.

18. An image forming apparatus, comprising:

a toner image forming unit that forms a toner image;

a transfer unit that transfers the toner image formed by the toner image forming unit to a recording medium; and a fixing unit that includes:

a fixing member that includes a conductive layer capable of self-heating by electromagnetic induction;

a drive unit that rotationally drives the fixing member;

a magnetic field generating member that generates an alternate-current magnetic field intersecting with the conductive layer of the fixing member;

a fixation pressing member that is movable to come into pressure contact with an outer circumferential surface of the fixing member and to separate from the outer circumferential surface; and a temperature measurement unit that includes a temperature detector and a support portion, that measures temperature of the fixing member with the temperature detector which is pressed by the support portion to be brought into contact with an inner circumferential surface of the fixing member, and that holds, with pressing force within a range set in advance, a contact state between the temperature detector and the inner circumferential surface of the fixing member in every state where the fixing member is displaced in accordance with movement of the fixation pressing member; and a magnetic path forming member that forms a magnetic path of the alternate-current magnetic field generated by the magnetic field generating member, and that conducts heat to the fixing member by self-heating by electromagnetic induction, wherein the temperature measurement unit is arranged at a position adjacent to an upstream edge of the magnetic path forming member at a side where a recording medium exits, and wherein the temperature measurement unit is arranged at any one of a position of a cutout and a position of a hole, any one of the cutout and the hole being formed at the upstream edge of the magnetic path forming member.

* * * * *